US006326133B1

(12) United States Patent
Hioki

(10) Patent No.: US 6,326,133 B1
(45) **Date of Patent: *Dec. 4, 2001**

(54) SILVER HALIDE PHOTOGRAPHIC MATERIAL

(75) Inventor: Takanori Hioki, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/193,849

(22) Filed: Nov. 18, 1998

(30) Foreign Application Priority Data

Nov. 19, 1997 (JP) ..... 9-318801
Sep. 1, 1998 (JP) ..... 10-247245

(51) Int. Cl.[7] ..... G03C 1/015

(52) U.S. Cl. ..... 430/567; 430/569; 430/590; 430/599; 430/600

(58) Field of Search ..... 430/567, 569, 430/590, 599, 600

(56) References Cited

U.S. PATENT DOCUMENTS 5,250,403 * 10/1993 Antoniades et al. ..... 430/505
5,985,535 * 11/1999 Urabe ..... 430/569

FOREIGN PATENT DOCUMENTS 0 789 691 A1 7/1997 (EP) .
786692 * 7/1997 (EP) .
0 786 690 A2 7/1997 (EP) .
0 786 692 A1 7/1997 (EP) .
2-4244 * 1/1990 (JP) .
6-110156 * 4/1994 (JP) .
6-230519 * 8/1994 (JP) .
7-84332 * 3/1995 (JP) .

OTHER PUBLICATIONS

Research Disclosure 308119, Jan. 1989.*

* cited by examiner

*Primary Examiner*—Janet Baxter
*Assistant Examiner*—Amanda C. Walke
(74) *Attorney, Agent, or Firm*—Sughrue, Mion, Zinn, Macpeak & Seas, PLLC

(57) ABSTRACT

Disclosed is a silver halide photographic material comprising a silver halide emulsion layer containing at least one specific compound, with examples including compounds represented by formula (I), wherein an average aspect ratio of silver halide emulsion grains constituting said silver halide emulsion layer is from 8 to 100:

(I)

wherein $Z_1$ represents atoms completing a 5- or 6-membered nitrogen-containing heterocyclic ring, $L_1$, $L_2$, $L_3$ and $L_4$ each represent a methine group, $V_1$ represents a monovalent substituent, $l_1$ is an integer of from 0 to 4, $p_1$ is 0 or 1, $n_1$ is 0, 1, 2 or 3, $R_1$ represents a hydrogen atom, an alkyl group, an aryl group or a heterocyclic group, $M_1$ represents a counter ion for adjusting the electric charge balance, $m_1$ is the number of counter ions necessary to render the molecule electrically neutral and ranges from 0 to 10, and La represents a methylene group.

10 Claims, 1 Drawing Sheet

SILVER HALIDE PHOTOGRAPHIC MATERIAL

FIELD OF THE INVENTION

The present invention relates to a silver halide photographic material having high sensitivity.

BACKGROUND OF THE INVENTION

Considerable efforts have been made to increase the sensitivity of silver halide photographic materials. In particular, there has been a strong desire for increasing the sensitivity of spectrally sensitized silver halide photographic materials.

The spectral sensitization art is a very important and essential technique used in producing photographic materials having high sensitivity and excellent color reproducibility. Spectral sensitizers have a function of absorbing light of long wavelengths which silver halide photographic emulsions cannot absorb in themselves and transmitting it to silver halides. Accordingly, an increase in the amount of light caught by spectral sensitizers is advantageous to enhancement of photographic sensitivity. Thus, attempts have been made at increasing the amount of light caught by spectral sensitizers via the increase in amount of spectral sensitizers added to a silver halide emulsion.

However, if they are added to a silver halide emulsion in an amount above the optimum, far from sensitizing, spectral sensitizers cause strong desensitization in the emulsion. This desensitization phenomenon is generally referred to as dye-induced desensitization, and caused by dyes in spectral regions wherein sensitizing dyes show no substantial absorption but silver halides have intrinsic sensitivity. If dyes cause strong desensitization, the sensitivity as a whole is decreased though they have spectral sensitization effect. In other words, the spectral sensitivities are increased in proportion as the desensitization by dyes is diminished. Therefore, the improvement of dye-induced desensitization is an important subject in the spectral sensitization art.

Further, as described in T. Tani, *Journal of Physical Chemistry*, vol. 94, p. 1298 (1990), the sensitizing dyes having reduction potentials more positive than −1.25 V are known to be low in relative quantum yield of spectral sensitization. For the purpose of heightening the relative quantum yield of spectral sensitization by dyes, it is proposed to carry out the supersensitization by positive hole capture as described in *The Theory of the Photographic Process*, pp. 259–265 (1966).

Compounds which can serve as a supersensitizer to get rid of the aforementioned desensitization are those having oxidation potentials smaller than sensitizing dyes. Such compounds are described, e.g., in U.S. Pat. Nos. 2,313,922, 2,075,046, 2,448,858 and 2,680,686, British Patent 1,230,449 and Belgian Patent 771,168.

However, the sensitivity increasing effects of those supersensitizers is still insufficient, so further increase in sensitivity has been required.

In the meantime; tabular silver halide grains (hereinafter referred to as "tabular grains") have photographic characteristics as mentioned below:

1) As tabular grains are great in the ratio of surface area to volume, a large quantity of sensitizing dye can be adsorbed to the grain surface; as a result, higher color sensitization sensitivity can be obtained.
2) When an emulsion comprising tabular grains is coated on a support and dried, the grains are oriented in parallel with the support surface; as a result, the coated layer can have a reduced thickness to enhance the sharpness.
3) As the tabular grains oriented parallel to the support keep their shape and orientation even after development, the developed silver can have high covering power. This characteristic enables further reduction in the amount of coated silver which is required for attaining a definite photographic density, particularly in X-ray films.
4) The tabular grains oriented parallel to the support cause slight scattering of light, so they can provide an image of high resolution, and
5) When used in a green-sensitive or red-sensitive layer, the tabular grains enable the emulsion to reduce or to remove yellow filter because they have low sensitivity to blue light.

In U.S. Pat. No. 4,439,520 is described the color photographic material that undergoes improvements in sharpness, sensitivity and graininess by using tabular grains having a thickness less than 0.3 μm, a diameter of at least 0.6 μm and an aspect ratio of at least 8 in at least either a green-sensitive layer or a red-sensitive layer. The term aspect ratio as used herein refers to the ratio of the thickness to the diameter of a tabular grain. Additionally, the expression "diameter of a tabular grain" means the diameter of a circle having the same area as the projected area of a tabular grain determined by observing tabular grains in an emulsion under a microscope or electron microscope. And the expression "thickness of a tabular grain" means the distance between two parallel surfaces forming a tabular grain.

The photographic element comprising silver bromide or iodobromide tabular grains having an average diameter of 0.4–0.55 μm and an aspect ratio of at least 8 is described in U.S. Pat. No. 4,693,964. And the tabular grains having an average diameter of 0.5 μm and a thickness of 0.04 μm are described in Examples of the patent cited above. In addition, the photographic element comprising silver bromide or iodobromide tabular grains having an average diameter of 0.22–0.55 μm and an aspect ratio of at least 8 is described in U.S. Pat. No. 4,672,027. And in Examples of this U.S. Patent are described the tabular grains having a thickness of 0.04 μm.

Further, U.S. Pat. No. 5,250,403 discloses the color photographic element that contains in a minus blue (green and/or red) layer tabular grains having (111) major surfaces, an average diameter of at least 0.7 μm and an average thickness of less than 0.07 μm. Hereinafter, the tabular grains having an average thickness of less than 0.07 μm are referred to as "very thin" tabular grains. In the above-cited U.S. Patent, there are descriptions such that a very thin tabular grain emulsion is attractive by its sensitivity-graininess relationship and, ensuring as it does high image sharpness, the use of such an emulsion in a color photographic element, particularly in a minus blue recording emulsion layer, is favorable.

European Patent 362,699 discloses tabular grains which have a ratio of at least 0.7 between their aspect ratio and their diameter. And the Example of this European patent describes the preparation of tabular grains having a thickness of 0.04 μm.

Thus, studies have so far converged on development of tabular grains further increased in aspect ratio and further decreased in thickness for the purpose of bringing good features of tabular grains into full play. On the other hand, desires for photographs of higher quality are still strong, and it has been required to develop the art of further heightening the sensitivity.

As mentioned above, the surface area of a tabular grain bears a great ratio to the volume thereof, and a large quantity of sensitizing dye can be adsorbed to the grain surface to enable the achievement of higher color sensitization sensitivity. Therein, it is thought that increasing the absorptivity of a sensitizing dye can increase the efficiency in transferring light energy from the sensitizing dye to silver halide to achieve the enhancement of spectral sensitivity.

However, the amount of sensitizing dye adsorbed to the silver halide grain surface has its limit, and is difficult to increase beyond the amount required for single-layer saturated adsorption. Therefore, it is expected to find the art of further increasing the sensitivity.

SUMMARY OF THE INVENTION

An object of the present invention is to provide a silver halide photographic material having high sensitivity.

Silver halide photographic materials according to the following embodiments (1) to (8) are provided to attain the above object of the present invention:

(1) A silver halide photographic material comprising a silver halide emulsion layer containing at least one compound selected from the group consisting of compounds represented by the following formulae (I), (II), (III) and (IV) wherein an average aspect ratio of silver halide emulsion grains constituting said silver halide emulsion layer is from 8 to 100:

(I)

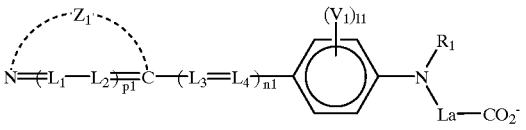

$M_1m_1$ wherein $Z_1$ represents atoms completing a 5- or 6-membered nitrogen-containing heterocyclic ring, $L_1$, $L_2$, $L_3$ and $L_4$ each represent a methine group, $V_1$ represents a monovalent substituent, $l_1$ is an integer of from 0 to 4, $p_1$ is 0 or 1, $n_1$ is 0, 1, 2 or 3, $R_1$ represents a hydrogen atom, an alkyl group, an aryl group or a heterocyclic group, $M_1$ represents a counter ion for adjusting the electric charge balance, $m_1$ is the number of counter ions necessary to render the molecule electrically neutral and ranges from 0 to 10, and La represents a methylene group;

(II)

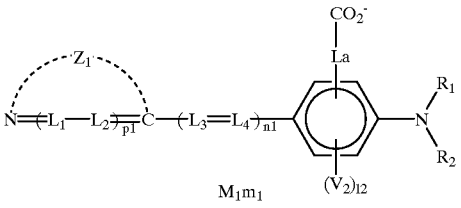

$M_1m_1$ wherein $Z_1$, $L_1$, $L_2$, $L_3$, $L_4$, $R_1$, $p_1$ $n_1$, $M_1$, $m_1$ and La have the same meanings as those in formula (I) respectively, $R_2$ has the same meaning as $R_1$, $V_2$ has the same meaning as $V_1$ in formula (I), and $l_2$ is an integer of from 0 to 3;

(III)

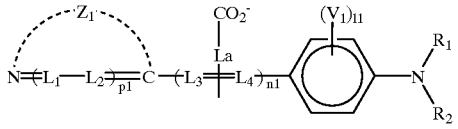

$M_1m_1$ wherein $Z_1$, $L_1$, $L_2$, $L_3$, $L_4$, $R_1$, $R_2$, $V_1$, $l_1$, $p_1$, $n_1$, $M_1$, $m_1$ and La have the same meanings as those in formula (I) or(II) respectively, provided that at least either $L_3$ or $L_4$ has La—$CO_{2-}$ as a substituent; and (IV)

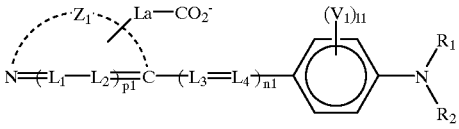

$M_1m_1$ wherein $Z_1$, $L_1$, $L_2$, $L_3$, $L_4$, $R_1$, $R_2$, $V_1$, $l_1$, $p_1$, $n_1$, $M_1$, $m_1$ and La have the same meanings as those in formula (I) or (II) respectively, provided that the nitrogen-containing heterocyclic ring completed by $Z_1$ has at least one La—$CO_2^-$ as a substituent.

(2) A silver halide photographic material according to the above embodiment (1), wherein said silver halide emulsion grains are emulsion grains spectrally sensitized with a sensitizing dye.

(3) A silver halide photographic material according to the above embodiment (1) or (2), wherein said silver halide emulsion is a tabular grain emulsion prepared by feeding an aqueous solution of water-soluble silver salt and an aqueous solution of water-soluble halide into a mixing vessel arranged separately from a reaction vessel for carrying out a nucleation process and/or a growth process, stirring and mixing the aqueous solutions in the mixing vessel, thereby forming fine grains of silver halide, and feeding immediately the formed fine grains into the reaction vessel and making them undergo nucleation and/or growth in the reaction vessel.

(4) A silver halide photographic material according to the above embodiment (3), wherein the mixing vessel is provided with (i) a closed stirring tank having at least the desired number of inlets for feeding an aqueous solution of water-soluble silver salt and an aqueous solution of water-soluble halide and an outlet for discharging the silver halide fine grain emulsion formed upon completion of the stirring and (ii) a stirring means that is arranged inside the stirring tank and has no shaft passing through the tank wall but has at least one stirring blade which is driven into rotating to control a stirred condition of the liquid in the tank.

(5) A silver halide photographic material according to any one of the above embodiments (1) to (4), wherein the silver halide emulsion comprises an emulsion made in the presence of a gelatin having the carboxyl groups introduced in a ratio of at least one carboxyl group to one primary amino group by chemical modification of primary amino groups present therein.

(6) A silver halide photographic material according to any one of the above embodiments (1) to (5), wherein the silver halide emulsion is an emulsion prepared going through (a) a process of forming silver halide nuclei comprising twinned microcrystals in a dispersing medium under a condition that the chlorine content in the silver halide nuclei is at least 10 mole % to the silver content therein, (b) a process of ripening the silver halide nuclei so that tabular nuclei remain preferentially, and (c) a process of forcing the tabular nuclei to grow into tabular grains.

(7) A silver halide photographic material according to any one of the above embodiments (1) to (6), wherein the methylene group represented by La in formulae (I) to (IV) is a methylene group substituted with a substituted or unsubstituted alkyl group.

(8) A silver halide photographic material according to any one of the above embodiments (1) to (6), wherein the compound contained in the silver halide emulsion layer is a compound represented by formula (I) in which the La is a methylene group substituted with a substituted or unsubstituted alkyl group.

DETAILED DESCRIPTION OF THE INVENTION

Figure 1:
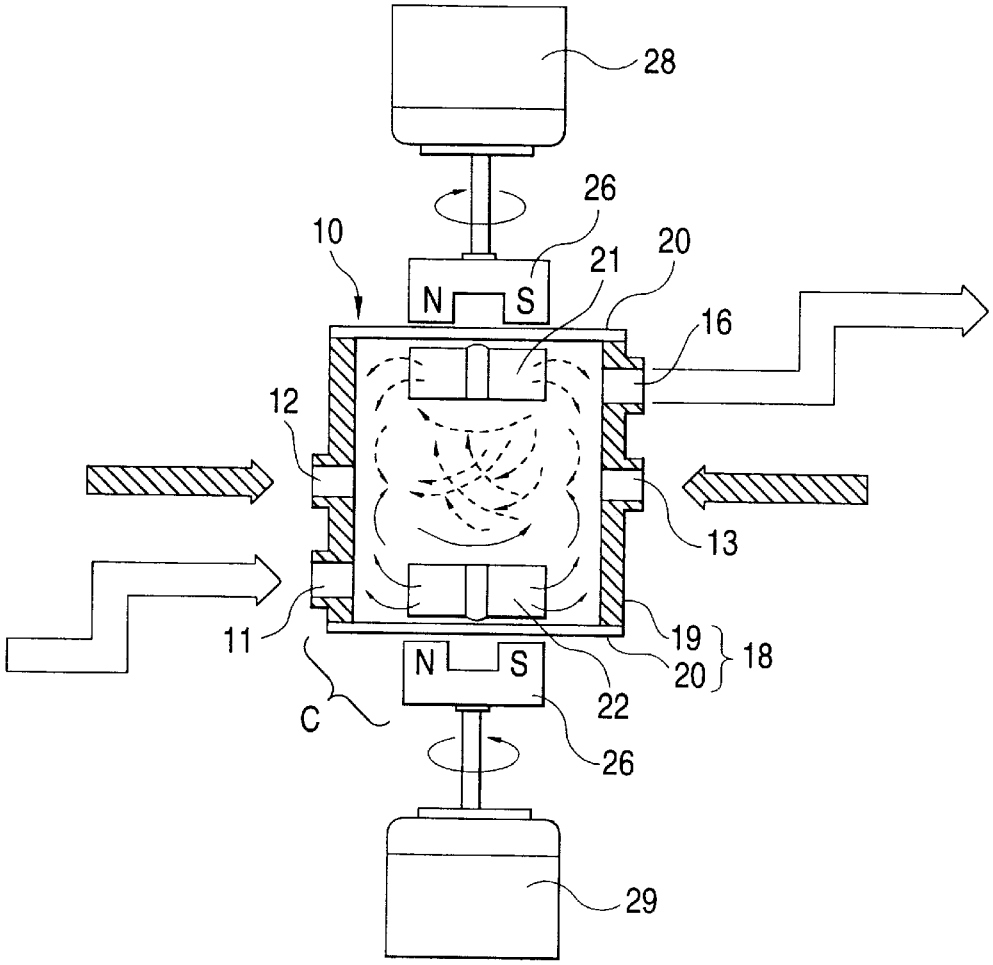
FIG. 1 is a rough sectional view schematically illustrating an example of a mixing vessel used in the process of a silver halide emulsion according to the present invention.

The compounds used in the present invention are described below in detail.

Examples of a 5- or 6-membered nitrogen-containing heterocyclic ring completed by $Z_1$ in formulae (I), (II), (III) and (IV) each include a thiazoline nucleus, a thiazole nucleus, a benzothiazole nucleus, anoxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and a pyrimidine nucleus.

Of these nuclei, benzoxazole, benzothiazole, benzimidazole and quinoline nuclei are preferred over the others. More preferably, $Z_1$ represents atoms completing a benzoxazole or benzothiazole nucleus, especially a benzothiazole nucleus. The nuclei as recited above may have a substituent.

Such a substituent (hereinafter represented by V) has no particular restriction, but examples thereof include a halogen atom (e.g., chlorine, bromine, iodine, fluorine), a mercapto group, a cyano group, a carboxyl group, a phospho group, a sulfo group, a hydroxyl group, a carbamoyl group containing 1 to 10, preferably 2 to 8, more preferably 2 to 5, carbon atoms (e.g., methylcarbamoyl, ethylcarbamoyl, morpholinocarbonyl), a sulfamoyl group containing 0 to 10, preferably 2 to 8, more preferably 2 to 5, carbon atoms (e.g., methylsulfamoyl, ethylsulfamoyl, piperidinosulfonyl), a nitro group, an alkoxy group containing 1 to 20, preferably 1 to 10, more preferably 1 to 8, carbon atoms (e.g., methoxy, ethoxy, 2-methoxyethoxy, 2-phenylethoxy), an aryloxy group containing 6 to 20, preferably 6 to 12, more preferably 6 to 10, carbon atoms (e.g., phenoxy, p-methylphenoxy, p-chlorophenoxy, naphthoxy), an acyl group containing 1 to 20, preferably 2 to 12, more preferably 2 to 8, carbon atoms (e.g., acetyl, benzoyl, trichloroacetyl), an acyloxy group containing 1 to 20, preferably 2 to 12, more preferably 2 to 8, carbon atoms (e.g., acetyloxy, benzoyloxy), an acylamino group containing 1 to 20, preferably 2 to 12, more preferably 2 to 8, carbon atoms (e.g., acetylamino), a sulfonyl group containing 1 to 20, preferably 1 to 10, more preferably 1 to 8, carbon atoms (e.g., methanesulfonyl, ethanesulfonyl, benzenesulfonyl), a sulfinyl group containing 1 to 20, preferably 1 to 10, more preferably 1 to 8, carbon atoms (e.g., methanesulfinyl, benzenesulfinyl), a sulfonylamino group containing 1 to 20, preferably 1 to 10, more preferably 1 to 8, carbon atoms (e.g., methanesulfonylamino, ethanesulfonylamino, benzenesulfonylamino), an amino group, a substituted amino group containing 1 to 20, preferably 1 to 12, more preferably 1 to 8, carbon atoms (e.g., methylamino, dimethylamino, benzylamino, anilino, diphenylamino), an ammonium group containing 0 to 15, preferably 3 to 10, more preferably 3 to 6, carbon atoms (e.g., trimethylammonium, triethylammonium), a hydrazino group containing 0 to 15, preferably 1 to 10, more preferably 1 to 6, carbon atoms (e.g., trimethylhydrazino), an ureido group containing 1 to 15, preferably 1 to 10, more preferably 1 to 6, carbon atoms (e.g., ureido, N,N-dimethylureido), an imido group containing 1 to 15, preferably 1 to 10, more preferably 1 to 6, carbon atoms (e.g., succinimido), an alkylthio or arylthio group containing 1 to 20, preferably 1 to 12, more preferably 1 to 8, carbon atoms (e.g., methylthio, ethylthio, carboxyethylthio, sulfobutylthio, phenylthio), an alkoxycarbonyl group containing 2 to 20, preferably 2 to 12, more preferably 2 to 8, carbon atoms (e.g., methoxycarbonyl, ethoxycarbonyl, benzyloxycarbonyl), an aryloxycarbonyl group containing 6 to 20, preferably 6 to 12, more preferably 6 to 8, carbon atoms (e.g., phenoxycarbonyl), an unsubstituted alkyl group containing 1 to 18, preferably 1 to 10, more preferably 1 to 5, carbon atoms (e.g., methyl, ethyl, propyl, butyl), a substituted alkyl group containing 1 to 18, preferably 1 to 10, more preferably 1 to 5, carbon atoms (such as hydroxymethyl, trifluoromethyl, benzyl, carboxyethyl, ethoxycarbonylmethyl or acetylaminomethyl, and further including unsaturated hydrocarbon groups containing 2 to 18, preferably 3 to 10, particularly preferably 3 to 5, carbon atoms (e.g., vinyl, ethynyl, 1-cyclohexenyl, benzylidyne, benzylidene)), a substituted or unsubstituted aryl group containing 6 to 20, preferably 6 to 15, more preferably 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl), and an unsubstituted or substituted heterocyclic group containing 1 to 20, preferably 2 to 10, more preferably 4 to 6, carbon atoms (e.g., pyridyl, 5-methylpyridyl, thienyl, furyl, morpholino, tetrahydrofurfuryl). Also, V can be a substituent to form a benzene, naphthalene or anthracene ring fused together with the heterocyclic ring completed by $Z_1$. Further, the substituents recited above may further be substituted by V.

The above-recited alkyl group, aryl group, alkoxy group, halogen atom, acyl group, cyano group, sulfonyl group and benzene moiety fused are preferred as the substituent V. More preferable V is the above-recited alkyl group, aryl group, halogen atom, acyl group, sulfonyl group or benzene moiety fused. Particularly preferable V is a methyl group, a phenyl group, a methoxy group, a chlorine atom, a bromine atom, an iodine atom or a benzene moiety fused. The most preferable V is a phenyl group, a chlorine atom, a bromine atom or an iodine atom.

In the case where the substituent V is La—$CO_2^-$, it may be attached directly to the azole moiety of the heterocyclic ring completed by $Z_1$. Also, it may be attached to the fused ring moiety of an azole ring, such as a benzene or naphthalene moiety.

$R_1$ and $R_2$ each represent a hydrogen atom, an alkyl group, an aryl group or a heterocyclic group. As examples of such an alkyl group, mention may be made of unsubstituted alkyl groups containing 1 to 18, preferably 1 to 7, particularly preferably 1 to 4, carbon atoms (e.g., methyl, ethyl, propyl, isopropyl, butyl, isobutyl, hexyl, octyl, dodecyl, octadecyl) and substituted alkyl groups containing 1 to 18, preferably 1 to 7, particularly preferably 1 to 4, carbon atoms, such as alkyl groups substituted by V the examples of which are recited in the above description of the heterocyclic ring completed by $Z_1$.

Suitable examples of such a substituted alkyl group include an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethyl)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfoalkenyl group (e.g., sulfopropenyl), a sulfatoalkyl group (e.g., 2-sulfatoethyl, 3-sulfatopropyl, 4-sulfatobutyl), a hetero ring-substituted alkyl group (e.g., 2-(pyrrolidine-2-one-1-yl)ethyl, tetrahydrofurfuryl), and an alkylsulfonylcarbamoylmetyhyl group (e.g., methanesulfonylcarbamoylmethyl).

Other examples of $R_1$ and $R_2$ each include an unsubstituted aryl group containing 6 to 20, preferably 6 to 10, more preferably 6 to 8, carbon atoms (e.g., phenyl, 1-naphthyl), a substituted aryl group containing 6 to 20, preferably 6 to 10, more preferably 6 to 8, carbon atoms (e.g., aryl groups substituted by V, examples of which are recited in the above description of the heterocyclic ring completed by $Z_1$, such as p-methoxyphenyl, p-methylphenyl and p-chlorophenyl groups), an unsubstituted heterocyclic group containing 1 to 20, preferably 3 to 10, more preferably 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazinyl, 2-pyrimidyl, 3-pyrazinyl, 2-(1,3,5-triazolyl), 3-(1,2,4-triazolyl), 5-tetrazolyl), and a substituted heterocyclyl group containing 1 to 20, preferably 3 to 10, more preferably 4 to 8, carbon atoms (e.g., heterocyclyl groups substituted by V, examples of which are recited in the above description of the heterocyclic ring completed by $Z_1$, such as 5-methyl-2-thienyl and 4-methoxy-2-pyridyl groups).

Preferably, $R_1$ and $R_2$ are each an alkyl, aryl or heterocyclic group. Of these groups, the unsubstituted alkyl group as recited above (e.g., methyl, ethyl, butyl), the substituted alkyl group as recited above (e.g., 2-sulfoethyl, 3-sulfopropyl, 4-sulfobutyl, carboxymethyl, 2-carboxylethyl), the unsubstituted aryl group as recited above (e.g., phenyl, naphthyl) and the unsubstituted heterocyclic group as recited above (e.g., 2-pyridyl, 2-thiazolyl) are much preferable. In particular, the substituted and unsubstituted alkyl groups as recited above are favored over the others. However, acyl-substituted alkyl groups are excluded therefrom. The most preferred groups for $R_1$ and $R_2$ each are unsubstituted alkyl groups.

$L_1$, $L_2$, $L_3$ and $L_4$ each represent a methine group which may have a substituent. Examples of such a substituent include a substituted or unsubstituted alkyl group containing 1 to 15, preferably 1 to 10, more preferably 1 to 5, carbon atoms (e.g., methyl, ethyl, 2-carboxyethyl), a substituted or unsubstituted aryl group containing 6 to 20, preferably 6 to 15, more preferably 6 to 10, carbon atoms (e.g., phenyl, o-carboxyphenyl), a substituted or unsubstituted heterocyclic group containing 3 to 20, preferably 4 to 15, more preferably 6 to 10, carbon atoms (e.g., N,N-diethylbarbituric acid), a halogen atom (e.g., chlorine, bromine, fluorine, iodine), an alkoxy group containing 1 to 15, preferably 1 to 10, more preferably 1 to 5, carbon atoms (e.g., methoxy, ethoxy), an alkylthio group containing 1 to 15, preferably 1 to 10, more preferably 1 to 5, carbon atoms (e.g., methylthio, ethylthio), an arylthio group containing 6 to 20, preferably 6 to 15, more preferably 6 to 10, carbon atoms (e.g., phenylthio), and an amino group containing 0 to 15, preferably 2 to 10, more preferably 4 to 10, carbon atoms (e.g., N,N-diphenylamino, N-methyl-N-phenylamino, N-methylpiperazino). Further, the substituent may combine any two of $L_1$ to $L_4$ to form a ring. In addition, the methine group represented by any of $L_1$ to $L_4$ can combine with another site via a substituent to form a ring. However, an unsubstituted methine group is preferred as $L_1$ to $L_4$ each.

$n_1$ is preferably 1 or 2, and more preferably 1. When $n_1$ is 2 or above, the methine groups repeated may not be the same.

$M_1$ is introduced in each formula for showing the presence of cation or anion when required for neutralizing the ionic charge of each dye molecule. Examples of a typical cation include hydrogen ion ($H^+$), inorganic ions such as an alkali metal ion (e.g., sodium ion, potassium ion, lithium ion) and an alkaline earth metal ion (e.g., calcium ion), and organic ions such as an ammonium ion (e.g., ammonium, tetraalkylammonium, pyridinium, ethylpyridinium). Also, the anion can include both inorganic and organic ones. As examples thereof, mention may be made of a halogen anion (such as fluorine, chlorine or iodine ion), a substituted arylsulfonic acid ion (such as p-toluenesulfonic or p-chlorobenzenesulfonic acid ion), an aryldisulfonic acid ion (such as 1,3-benzenedisulfonic, 1,5-naphthalenedisulfonic or 2,6-naphthalenedisulfonic acid ion), an alskylsulfinic acid ion (such as methylsulfuric acid ion), sulfuric acid ion, thiocyanic acid ion, perchloric acid ion, tetrafluoroboric acid ion, picric acid ion, acetic acid ion, and trifluoromethanesulfonic acid ion. Further, $M_1$ may be an ionic polymer or another dye having opposite charge.

Additionally, although the sulfo and carboxyl groups are represented by $SO_3^-$ and $CO_2^-$ respectively in the present invention, they can be represented by $SO_3H$ and $CO_2H$ respectively when their counter ion is hydrogen ion.

$m_1$ is the number of counter ions necessary for adjusting the electric charge balance, and it is 0 when each dye molecule forms an inner salt.

Each $p_1$ is 0 or 1, preferably 1.

$V_1$ represents a monovalent substituent, including those recited as examples of the substituent V. Preferably, $V_1$ is a substituted or unsubstituted alkyl group, a halogen atom or a substituted or substituted alkoxy group. Of these groups, unsubstituted alkyl groups are especially favored as $V_1$.

$l_1$ is an integer of from 0 to 4, preferably 0 or 1, and more preferably 1.

La represents a methylene group which may have a substituent. Examples of such a substituent include a substituted or unsubstituted alkyl group containing 1 to 15, preferably 1 to 10, more preferably 1 to 5, carbon atoms (e.g., methyl, ethyl, 2-carboxyethyl), a substituted or unsubstituted aryl group containing 6 to 20, preferably 6 to 15, more preferably 6 to 10, carbon atoms (e.g., phenyl, o-carboxyphenyl), a substituted or unsubstituted heterocyclic group containing 3 to 20, preferably 4 to 15, more preferably 6 to 10, carbon atoms (e.g., N,N-diethylbarbituric acid), a halogen atom (e.g., chlorine, bromine, fluorine, iodine), an alkoxy group containing 1 to 15, preferably 1 to 10, more preferably 1 to 5, carbon atoms (e.g., methoxy, ethoxy), an alkylthio group containing 1 to 15, preferably 1 to 10, more preferably 1 to 5, carbon atoms (e.g., methylthio, ethylthio), an arylthio group containing 6 to 20, preferably 6 to 15, more preferably 6 to 10, carbon atoms (e.g., phenylthio), and an amino group containing 0 to 15, preferably 2 to 10, more preferably 4 to 10, carbon atoms (e.g., N,N-diphenylamino, N-methyl-N-phenylamino, N-methylpiperazino). La in formula (I) is preferably a methylene group substituted by a substituted or unsubstituted alkyl group, more preferably a methylene group substituted by an unsubstituted alkyl group, and particularly preferably a methylene group substituted by a methyl group.

Similarly to La in formula (I), La in each of the formulae (II), (III) and (IV) is preferably a methylene group substituted by a substituted or unsubstituted alkyl group, more preferably a methylene group substituted by an unsubstituted alkyl group, and particularly preferably a methylene group substituted by a methyl group.

The $CO_2^-$ bonded to La can be in the undissociated state depending on the pH of the emulsion layer. In this case, it can be represented by $CO_2H$.

Of the compounds represented by formulae (I) to (IV), the compounds represented by formulae (I), (II) and (IV) respectively are preferred, and the compounds represented by formulae (I) and (IV) respectively are more preferred, and the compounds represented by formula (I) are preferred in particular.

Specific examples of compounds represented by formulae (I), (II), (III) and (IV) respectively are illustrated below, but it should be understood that these examples are not to be construed as limiting the scope of the invention in any way.

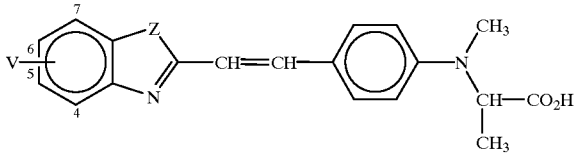

| Compound | Z | V |
|---|---|---|
| (1) | S | H |
| (2) | " | 5-Ph |
| (3) | " | 5-$CH_3$ |

-continued

| | | |
|---|---|---|
| (4) | " | 4,5-benzo |
| (5) | " | 6,7-benzo |
| (6) | " | 5,6-$(CH_3)_2$ |
| (7) | " | 5-$OCH_3$ |
| (8) | O | H |
| (9) | " | 5-Ph |
| (10) | " | 4,5-benzo |
| (11) | " | 5-Br |
| (12) | " | 5-Cl |
| (13) | Se | H |
| (14) | " | 5-$CH_3$ |
| (15) | Te | H |
| (16) | " | 5-$CH_3$ |
| (17) | N-$C_2H_5$ | 5,6-$Cl_2$ |
| (18) | " | H |
| (19) | " | 5-$CF_3$ |
| (20) | $C(CH_3)_2$ | H |
| (21) | " | 6 7-benzo |
| (22) | " | 5-$CO_2H$ |

(23)

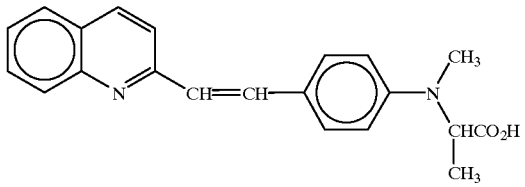

(24)

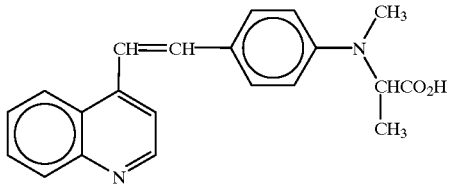

(25)

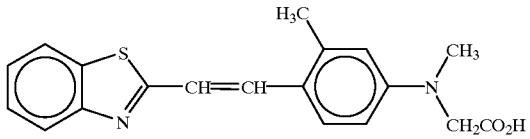

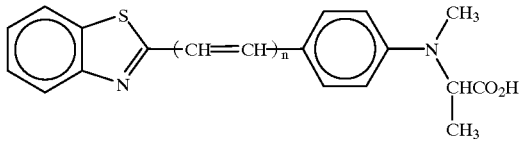

(26) n = 2

(27) n = 3

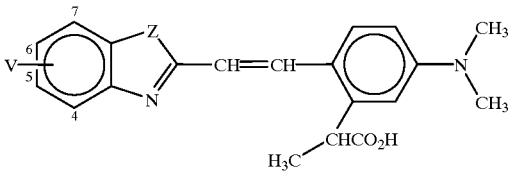

| Compound | Z | V |
|---|---|---|
| (28) | S | H |
| (29) | " | 5-Cl |
| (30) | " | 5,6-benzo |
| (31) | O | N |
| (32) | O | 5-Ph |

-continued

| | | |
|---|---|---|
| (33) | Se | H |
| (34) | N-$CH_3$ | 5,6-$Cl_2$ |
| (35) | $C(CH_3)_2$ | H |

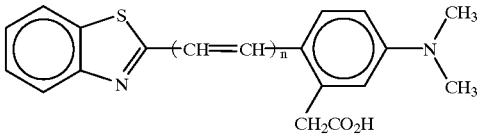

| | |
|---|---|
| (36) | n = 2 |
| (37) | n = 3 |

(38)

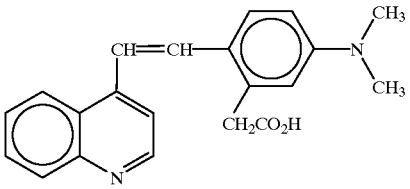

(39)

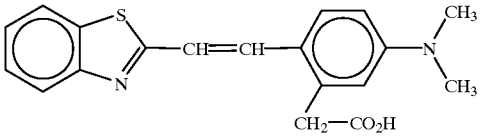

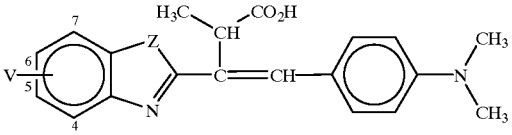

| Compound | Z | V |
|---|---|---|
| (40) | S | H |
| (41) | " | 5-Cl |
| (42) | " | 4,5-benzo |
| (43) | O | 5,6-$(OCH_3)_2$ |
| (44) | " | H |
| (45) | Se | H |
| (46) | N-$C_2H_5$ | 5-$CF_3$ |
| (47) | $C(CH_3)_2$ | H |

(48)

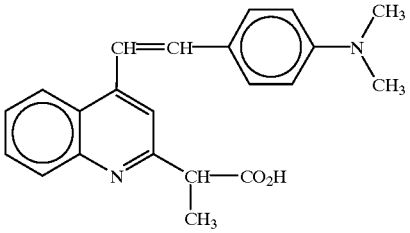

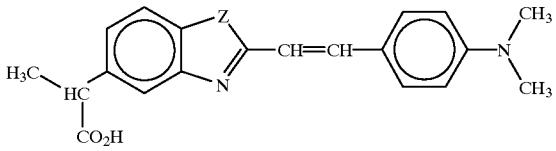

| | |
|---|---|
| (49) | Z = O |
| (50) | Z = S |
| (51) | Z = Se |

-continued

| | |
|---|---|
| (52) | Z = N-$C_2H_5$ |
| (53) | Z = $C(CH_3)_2$ |

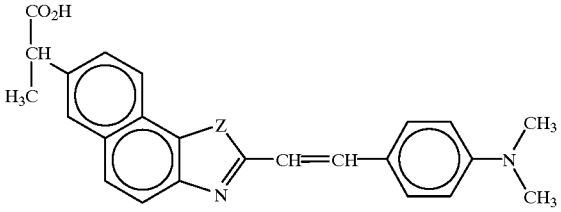

| | |
|---|---|
| (54) | Z = S |
| (55) | Z = O |
| (56) | Z = Se |
| (57) | Z = N-$C_2H_5$ |
| (58) | Z = $C(CH_3)_2$ |

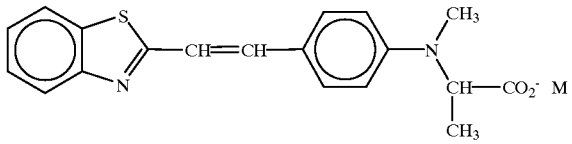

| | |
|---|---|
| (59) | M = $Na^+$ |
| (60) | M = $HN^+(C_2H_5)_3$ |
| (61) | M = $K^+$ |

(62)

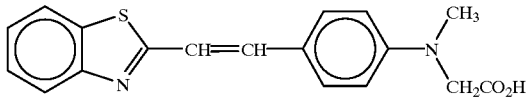

(63)

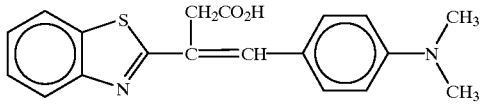

(64)

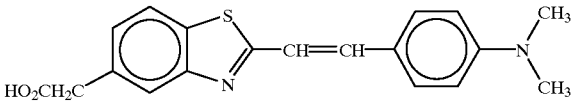

The present compounds represented by formulae (I), (II), (III) and (IV) respectively can be synthesized according to the methods described in, e.g., F. M. Harmer, *Heterocyclic Compounds—Cyanine Dyes and Related Compounds*, chapter 13, pages 433–437, John Wiley & Sons Co., New York, London (1964); D. M. Sturmer, *Heterocyclic Compounds—Special Topics in Heterocyclic Chemistry*, chapter 18, section 14, pages 482–515, John Wiley & Sons Co., Inc., New York, London (1977); and *Rodd's Chemistry of Carbon Compounds*, 2nd Ed., Vol. IV, part B, chapter 15, pages 369–422, Elsevier Science Publishing Company Inc., New York (1977).

Synthesis Example (Synthesis of Compound (1)):

The Compound (1) exemplified above can be synthesized in accordance with the following scheme;

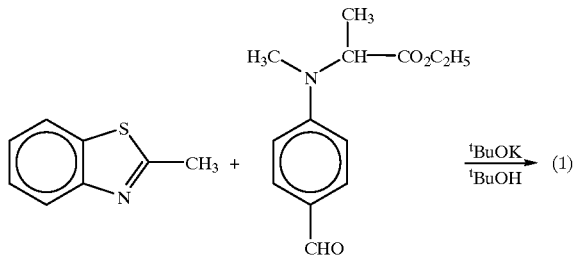

(a) (b)

To a mixture of 2 g (13.4 mmol) of compound (a), 3.8 g (17.4 mmol) of compound (b) and 25 ml of t-butanol, 3.5 g (30.8 mmol) of potassium t-butoxide was added. The resulting mixture was stirred for 1 hour as it was heated on an oil bath of the external temperature of 100° C., and then admixed with 200 ml of water, and further adjusted to pH 2–3 with conc. hydrochloric acid. The crystals thus deposited were filtered with suction, and washed with water. The resulting crystals were admixed with a mixed solvent constituted of 100 ml of methanol and 100 ml of chloroform, and heated under reflux to be dissolved completely in the mixed solvent, followed by spontaneous filtration. The chloroform in the filtrate was distilled away under ordinary pressure, and the residue on distillation was allowed to stand at room temperature. The crystals thus deposited were filtered with suction, washed with 100 ml of methanol, and then dried. Thus, 1.9 g of Compound (1) was obtained. (yield: 42%, $\lambda_{max}$=398 nm ($\epsilon$=34700) in methanol)

Although the present compounds of formulae (I) to (IV) (also referred to as "the present compounds", hereinafter) may be used independently, it is desirable for them to be used in combination with other spectral sensitizing dyes.

In the next place, the present silver halide photographic materials are described in detail.

The silver halide emulsion grains usable in the present silver halide photographic materials are tabular silver halide grains the surface area/volume ratio of which is higher than usual, and which is adsorbed by the present compound of formula (I), (II), (III) or (IV) and, if desired, a sensitizing dye as described hereinafter. More specifically, the aspect ratio of these tabular silver halide grains is from 8 to 100, preferably from 14 to 80, particularly preferably from 20 to 80, and the thickness thereof is less than 0.2 $\mu$m, preferably less than 0.1 $\mu$m, particularly preferably less than 0.07 $\mu$m. In order to prepare thin tabular grains having such a high aspect ratio, the following technology is applied.

The producing method of silver halide emulsion according to the present invention is described in detail below.

The silver halide emulsion according to the present invention can be produced through a process of nucleation→ripening→growth.

Each process of nucleation, ripening and growth are described below.

1. Nucleation

The nucleation of tabular grains is in general carried out by a double jet method comprising adding a silver salt aqueous solution and an alkali halide aqueous solution to a reaction vessel containing a protective colloid aqueous solution, or a single jet method comprising adding a silver salt aqueous solution to a protective colloid solution containing alkali halide. If necessary, a method comprising adding an alkali halide aqueous solution to a protective colloid solution containing silver salt may be used. Further, if necessary, a method comprising adding a protective colloid solution, a silver salt solution and an alkali halide aqueous solution to the mixer disclosed in JP-A-2-44335, and immediately transfer the mixture to a reaction vessel may be used for the nucleation of tabular grains. Further, as disclosed in U.S. Pat. No. 5,104,786, nucleation can be performed by passing an aqueous solution containing alkali halide and a protective colloid solution through a pipe and adding a silver salt aqueous solution thereto.

Gelatin is used as protective colloid but natural high polymers besides gelatin and synthetic high polymers can also be used in the present invention. Alkali-processed gelatin, oxidized gelatin, i.e., gelatin in which a methionine group in the gelatin molecule is oxidized with hydrogen peroxide, etc. (a methionine content of 40 $\mu$mol/g or less), amino group-modified gelatin (e.g., phthalated gelatin, trimellitated gelatin, succinated gelatin, maleated gelatin, and esterified gelatin), and low molecular weight gelatin (molecular weight of from 3,000 to 40,000) are used. Further, natural high polymers are described in JP-B-7-111550 (the term "JP-B" as used herein means an "examined Japanese patent publication") and *Research Disclosure*, Vol. 176, No. 17643, item IX (December, 1978).

Excessive halides in the nucleation according to the present invention are $Cl^-$, $Br^-$ and $I^-$, and they can be used alone or in combination. The concentration of excessive halides is from $3\times10^{-5}$ mol/liter to 0.1 mol/liter, preferably from $3\times10^{-4}$ mol/liter to 0.01 mol/liter.

The temperature in the nucleation according to the present invention is preferably from 5 to 60° C., but when fine tabular grains having an average grain size of 0.5 $\mu$m or less are produced, the temperature is more preferably from 5 to 48° C.

The pH of the dispersion medium when amino group-modified gelatin is used is preferably from 4 to 8 but when other gelatins are used it is preferably from 2 to 8.

2. Ripening

In the nucleation described in 1. above, fine grains other than tabular grains are formed (in particular, octahedral and single twin grains). Accordingly, the grains other than tabular grains are necessary to be vanished before entering the following described growing process to obtain nuclei having the forms of becoming tabular grains and good monodispersibility. For this purpose, it is well known that Ostwald ripening is conducted subsequent to the nucleation.

pBr is adjusted just after nucleation, then the temperature is raised and ripening is carried out until the hexagonal tabular grain ratio reaches the maximum. At this time, protective colloid may be added additionally. The concentration of protective colloid to the dispersion medium solution at this time is preferably 10 wt % or less. The above-described alkali-processed gelatin, amino group-modified gelatin, oxidized gelatin, low molecular weight gelatin, natural high polymers and synthetic high polymers can be used as additional protective colloids.

Ripening is conducted at 40° C. to 80° C., preferably from 50° C. to 80° C., and pBr of from 1.2 to 3.0. pH is preferably from 4 to 8 when amino group-modified gelatin is used, and preferably from 2 to 8 when other gelatins are used.

A silver halide solvent may be used for rapidly vanishing grains other than tabular grains. The concentration of the silver halide solvent at this time is preferably from 0.3 mol/liter or less, more preferably 0.2 mol/liter or less. When the tabular grains are used as an emulsion for direct reversal use, neutral or acidic thioether compounds are better than alkaline $NH_3$ solvents.

Thus, almost pure tabular grains are obtained by the ripening.

After the ripening is finished, if the silver halide solvent is unnecessary in the next growth stage, the silver halide solvent is removed as follows.

(1) In the case of alkaline silver halide solvents such as $NH_3$, an acid having large solubility product with $Ag^+$ such as $HNO_3$ is added to be nullified.

(2) In the case of thioether based silver halide solvent, an oxidizing agent such as $H_2O_2$ is added to be nullified as disclosed in JP-A-60-136736.

3. Growth

The pBr during the crystal growing stage subsequent to the ripening process is preferably maintained at 1.4 to 3.5. When the concentration of protective colloid in a dispersion medium solution before entering the growing process is low (1 wt % or less), protective colloid is additionally added in some cases. The concentration of protective colloid in a dispersion medium solution at that time is preferably from 1 to 10 wt %. The above-described alkali-processed gelatin, amino group-modified gelatin, oxidized gelatin, natural high polymers and synthetic high polymers can be used as additional protective colloids. pH during growing is preferably from 4 to 8 when amino group-modified gelatin is present, and preferably from 2 to 8 when other gelatins are used. The feeding rate of $Ag^+$ and a halogen ion in the crystal growing stage is preferably adjusted to such a degree that the crystal growing speed becomes from 20 to 100%, more preferably from 30 to 100%, of the critical growing speed of the crystal. In this case, the feeding rates of a silver ion and a halogen ion are increased with the crystal growth of the grains and, as disclosed in JP-B-48-36890 and JP-B-52-16364, the feeding rates of an aqueous solution of silver salt and an aqueous solution of halide may be increased, alternatively, the concentrations of an aqueous solution of silver salt and an aqueous solution of halide may be increased.

Growing of silver halide grains can be performed by supplying a silver salt aqueous solution and a halide aqueous solution to a mixing chamber installed outside the reaction vessel, if necessary, protective colloid solution is further added, mixing and stirring the solutions to form silver halide fine grains, and immediately supplying the resultant silver halide fine grains to the reaction vessel to carry out the growth of silver halide grains in the reaction vessel. At this time, protective colloid (gelatin, synthetic high polymer, etc.) may be dissolved in the halide aqueous solution. As for this method, JP-A-10-43570 can be referred to.

Tabular silver halide grains having the halogen composition of silver chloride, silver bromide, silver chlorobromide, silver iodobromide, silver chloroiodobromide or silver iodochloride are used in the emulsion for use in the present invention. Tabular grains have {100} or {111} main planes. Tabular grains having {111} main planes (hereinafter referred to as {111} tabular grains) have, in general, triangular or hexagonal planes. When the grain size distribution becomes uniform, the ratio of tabular grains having hexagonal planes increases. Hexagonal monodisperse tabular grains are disclosed in JP-B-5-61205.

Tabular grains having {100} main planes (hereinafter referred to as {100} tabular grains) have rectangular or square shapes. In the emulsion of this type, grains having a ratio of adjacent side lengths of less than 5/1 are called tabular grains not acicular grains. In silver chloride tabular grains or high silver chloride content tabular grains, {100} tabular grains fundamentally exhibit higher stability of main plane surface as .compared with {111} tabular grains. In the case of {111} tabular grains, it is necessary to stabilize {111} main plane surface. Methods thereof are disclosed in JP-A-9-80660, JP-A-9-80656 and U.S. Pat. No. 5,298,388.

It is effective to use a polymer having a repeating unit represented by the following formula (A) for the monodispersion of {111} tabular grains:

$$-(R-O)_n- \quad (1)$$

wherein R represents an alkylene group having from 2 to 10 carbon atoms; and n represents the average number of repeating units, which is from 4 to 200.

In the formation of the emulsion for use in the present invention, a polymer having a repeating unit represented by formula (A) is preferably used, and a vinyl polymer having at least one monomer represented by formula (B) as a constituent or polyurethane represented by formula (C) is preferably used. A vinyl polymer having a repeating unit represented by formula (2) is particularly preferably used.

(B)

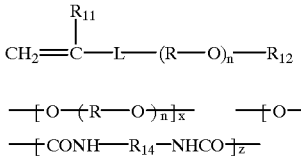

(C)

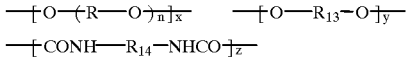

In formulae (B) and (C), R represents an alkylene group having from 2 to 10 carbon atoms; n represents the average number of repeating units, which is from 4 to 200; $R_{11}$ represents a hydrogen atom or a lower alkyl group having 1 to 4 carbon atoms; $R_{12}$ represents a monovalent substituent; and L represents a divalent linking group.

In formula (C), $R_{13}$ and $R_{14}$ each represents an alkylene group having from 1 to 20 carbon atoms, a phenylene group having from 6 to 20 carbon atoms, or an aralkylene group having from 7 to 20 carbon atoms; and x, y and z each represents weight percentage of each constituent, x represents from 1 to 70, y represents from 1 to 70, and z represents from 20 to 70, and x+y+z=100. Further detailed examples and general descriptions are disclosed in European Patents 513722, 513723, 513724, 513725, 514742, 514743, 518066 and JP-A-9-54377.

In the preparation of tabular grains having high aspect ratio, it is particularly effective to use gelatin of a low methionine content at formation of tabular grains, which is disclosed in JP-B-5-12696. Further, tabular grains having higher aspect ratio and thin thickness can be obtained by using amino group-modified gelatin. As for specific methods of modification of amino groups, U.S. Pat. Nos. 2,525,753, 3,118,766, 2,614,928, 2,614,929, JP-B-40-15585, JP-A-8-82883 and Nihon Shashin Gakkai-Shi, Vol. 58, page 25 (1995) can be referred to.

In the production of extremely thin tabular grains having high aspect ratio for use in the present invention, it is preferred to supply a water-soluble silver salt aqueous solution and a water-soluble halide aqueous solution to a mixing chamber installed outside the reaction vessel where a nucleation process and/or a grain growing process are(is) carried out, and mix the solutions to form silver halide fine grains, and immediately supply the silver halide fine grains to the reaction vessel and conduct nucleation and/or grain growth of silver halide grains in the reaction vessel. This method is disclosed in U.S. Pat. Nos. 4,879,208, 5,035,991, 5,270,159, European Patent 507701 and U.S. Pat. No. 5,250,403.

Figure 2:
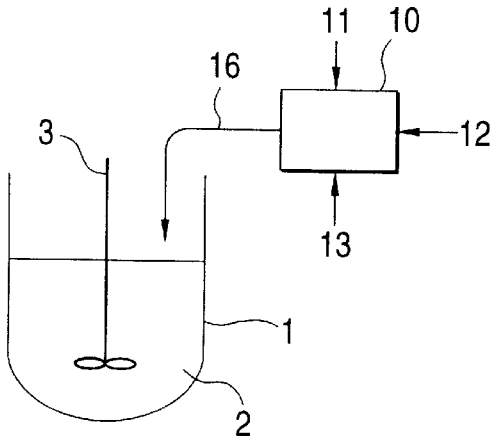
FIG. 2 is a flowchart showing an example of processes involved in making a silver halide emulsion according to the present invention.

The system of conducting the above-described nucleation and/or grain growth according to the present invention is shown in FIG. 2. In FIG. 2, a reaction vessel 1 contains a protective colloid aqueous solution 2. The protective colloid aqueous solution is stirred by stirring blades 3 attached to a rotary shaft (shown as a propeller type in this figure). A silver salt aqueous solution, a halide aqueous solution and, if necessary, a protective colloid aqueous solution are respectively introduced to a mixing chamber 10 installed outside of the reaction vessel through an addition system (supply ports 11, 12 and 13). In this case, if necessary, the protective colloid aqueous solution may be added in admixture with the silver salt aqueous solution and/or the halide aqueous solution. These solutions are rapidly and vigorously mixed in the mixing chamber 10, immediately introduced to the reaction vessel 1 through an exhaust port 16 and nucleation is conducted in the reaction vessel. At this time, the emulsion exhausted from the mixing chamber can be reserved in other container and added later to the reaction vessel.

After nucleation is finished in the reaction vessel 1, a silver salt aqueous solution, a halide aqueous solution and, if necessary, a protective colloid aqueous solution are further respectively introduced to the mixing chamber 10 through supply ports 11, 12 and 13. In this case, if necessary, the protective colloid aqueous solution may be added in admixture with the silver salt aqueous solution and/or the halide aqueous solution. These solutions are rapidly and vigorously mixed in the mixing chamber, immediately and continuously introduced to the reaction vessel 1 through the exhaust port 16 and the growth of nuclei already formed in the reaction vessel is conducted in the reaction vessel.

The mixing apparatus for forming silver halide fine grains for use in the present invention is further described below. Details thereof are disclosed in JP-A-10-43570.

The mixing apparatus consists of a stirring tank provided with a prescribed number of solution supply ports for supplying a water-soluble silver salt and a water-soluble halide to be stirred and a solution exhaust port for exhausting the silver halide fine grain emulsion after stirring processing, and stirring means for controlling the stirring condition of the solution in the stirring tank by rotation driving stirring blades. Stirring and mixing is conducted in the stirring tank by two or a more stirring blades which are rotation driven, and these at least two stirring blades are disposed confronting with each other with a distance between and rotation driven in converse directions. Each of the stirring blades has a magnetic coupling relation with the outer magnet disposed outside the tank wall adjacent to each stirring blade and each stirring blade does not have a rotary shaft protruding the tank wall and rotation driven by the motor connected to the outer magnet. A double sided bipolar magnet comprising an N pole face and an S pole face disposed so as to be parallel to a central axis line of rotation and superposed interposing the central axis of rotation is used in one of the stirring blades and the outer magnet coupled by magnetic coupling and a bilateral bipolar magnet comprising an N pole face and an S pole face standing abreast at symmetrical positions to the central axis of rotation on the plane orthogonal to the central axis line of rotation is used in another.

The executing mode of the mixing chamber (stirring apparatus) according to one embodiment of the present invention shown in FIG. 1 is described below.

A stirring tank 18 consists of a tank body 19 having a central axis of rotation facing in top and bottom directions and a seal plates 20 which function as tank walls sealing top and bottom opening ends of the tank body 19. Stirring blades 21 and 22 are disposed at the top and bottom ends of the stirring tank 18 confronting with each other with a distance between and rotation driven in converse directions. Stirring blades 21 and 22 each constitutes magnetic coupling C with an outer magnet 26 disposed outside the tank wall adjacent to each stirring blade 21 and 22. That is, each stirring blade 21 and 22 is linked to each outer magnet 26 by magnetic force and rotation operated in converse directions by rotation driving each outer magnet by independent motors 28 and 29, respectively.

A stirring tank 18 comprises solution supply ports 11, 12 and 13 for supplying a silver salt aqueous solution, a halide aqueous solution and, if necessary, a colloid aqueous solution to be stirred and a solution exhaust port 16 for exhausting the silver halide fine grain emulsion after stirring processing.

In the present invention, when opposite stirring blades are driven in the mixing chamber, the rotation speed is 1,000 rpm or more, preferably 3,000 rpm or more. Conversely rotating stirring blades may be rotated at the same rotating speed or different rotating speeds.

In tabular grain formation process in the present invention, at least during ripening or before growing process, ions other than halide may be added. It is preferred that ionic strength in a dispersion medium solution at this time is at least from 0.2 to 2.0, more preferably from 0.3 to 1.0. Preferred ions are described below but ions are not limited thereto.

As ions having positive electric charge, there can be cited $H^+$, $Na^+$, $Mg^{2+}$, $Ca^{2+}$, $K^+$, $Ba^{2+}$, $Sr^{2+}$, $Co^{2+}$, $Ni^{2+}$, $Cu^{2+}$, $Zn^{2+}$, $Al^{2+}$, etc., and divalent or more ions are preferred.

As ions having negative electric charge, $OH^-$, $NO_3^-$, $SO_4^{2-}$, $ClO_4^-$, $BF_4^-$, $BF_6^-$, $N_3^-$, $CN^-$, $C_2O_4^{2-}$, $SCN^-$, $CO_3^{2-}$, $COO^-$, etc., can be cited.

These ions are supplied as an inorganic salt aqueous solution. Examples of inorganic salts are described in Kagaku Benran, Kiso-Hen II (*Handbook of Chemistry, Elementary Course II*), pages 453–455 (published by Maruzen Co.), but they are not limited to these. The concentration of such inorganic aqueous solutions maybe appropriate, if it does not exceed saturation concentration. As other supplying method, inorganic salts may be directly added as they are in a powder state. The concentration at this time is not higher than saturation concentration.

Gelatin is used as protective colloid but natural high polymers besides gelatin and synthetic high polymers can also be used in the present invention. Alkali-processed gelatin, oxidized gelatin, i.e., gelatin in which a methionine group in the gelatin molecule is oxidized with hydrogen peroxide, etc. (a methionine content of 40 $\mu$mol/g or less), amino group-modified gelatin of the present invention (e.g., phthalated gelatin, trimellitated gelatin, succinated gelatin, maleated gelatin, and esterified gelatin), and low molecular weight gelatin (molecular weight of from 3,000 to 40,000) are used.

Further, natural high polymers are described in JP-B-7-111550 and *Research Disclosure*, Vol. 176, No. 17643, item IX (December, 1978).

Silver chloride {111} tabular grains or high silver chloride content {111} tabular grains for use in the present invention are disclosed in the following patents: U.S. Pat. Nos. 4,414,306, 4,400,463, 4,713,323, 4,783,398, 4,962,491, 4,983,508, 4,804,621, 5,389,509, 5,217,858 and 5,460,934.

High silver bromide content {111} tabular grains for use in the present invention are disclosed in the following patents: U.S. Pat. Nos. 4,425,425, 4,425,426, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

{100} Tabular grains for use in the present invention are disclosed in the following patents: U.S. Pat. Nos. 4,386,156, 5,275,930, 5,292,632, 5,314,798, 5,320,938, 5,319,635, 5,356,764, European Patents 569971, 737887, JP-A-6-308648 and JP-A-9-5911.

The sensitizing dyes used preferably in the present invention, though any sensitizing dyes are usable, include cyanine dyes, merocyanine dyes, rhodacyanine dyes, trinuclear cyanine dyes, holopolar cyanine dyes, hemicyanine dyes and styryl dyes. Details of such dyes are described in, e.g., F. M. Harmer, *Heterocyclic Compounds—Cyanine Dyes and Related Compounds*—, John Wiley & Sons, New York London (1964); and D. M. Sturmer, *Heterocyclic Compounds—Special Topics in Heterocyclic Chemistry*, Chapter 18, section 14, pages 482–515.

As for the general formulae of a cyanine dye, a merocyanine dye and a rhodacyanine dye respectively, the sensitizing dyes illustrated as those having formulae (XI), (XII) and (XIII) in U.S. Pat. No. 5,340,694, pages 21–22, are preferable.

In incorporating compounds according to the present invention or sensitizing dyes into the present silver halide photographic emulsion, they may be dispersed directly into the emulsion. Also, they may be dissolved first in an appropriate solvent, such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, acetonitrile, tetrahydrofuran, N,N-dimethylformamide or a mixture of two or more thereof, and then added to the emulsion.

Further, the compounds or dyes as mentioned above can be incorporated into the present emulsion according to, e.g., the method as described in U.S. Pat. No. 3,469,987, wherein the compounds or dyes are dissolved in a volatile organic solvent, dispersed into water or a hydrophilic colloid, and then added to the emulsion; the method as described in JP-B-46-24185 wherein the compounds or dyes, if insoluble in water, are dispersed into a water-soluble solvent, and then added to the emulsion; the method as described in JP-B-44-23389, JP-B-44-27555 and JP-B-57-22091, wherein the compounds or dyes are dissolved in an acid and then added to the emulsion, or they are made into an aqueous solution in the presence of an acid or base and then added to the emulsion; the method as described in U.S. Pat. Nos. 3,822,135 and 4,006,025, wherein the compounds or dyes are made into a aqueous solution or colloid dispersion in the presence of a surfactant and then added to the emulsion; the method as described in JP-A-53-102733 and JP-A-58-105141, wherein the compounds or dyes are dispersed directly into a hydrophilic colloid, and then added to the emulsion; or the method as described in JP-A-51-74624 wherein the compounds or dyes are dissolved with a red shift compound and then added to an emulsion.

Furthermore, the dissolution therein can be effected by the use of ultrasonic waves.

The time for the present compounds or sensitizing dyes usable in the present invention to be added to the present silver halide emulsion may be at any stage of emulsion-making as far as it has hitherto been admitted to be useful for the addition of such a supersensitizing combination. For instance, they may be added when the emulsion is in the stage of forming silver halide grains and/or in a period before desalting, or in the desalting stage and/or the period from desalting to the beginning of chemical ripening, as disclosed in U.S. Pat. Nos. 2,735,766, 3,628,960, 4,183,756 and 4,225,666, JP-A-58-184142 and JP-A-60-196749; or they may be added just before or in the stage of chemical ripening, or in any stage or step during the period from the completion of chemical ripening to the emulsion coating, as disclosed in JP-A-58-113920.

In addition, as disclosed in U.S. Pat. No. 4,225,666 and JP-A-58-7629, the same compound alone or in combination with a compound having a different structure may be added in separate periods, for example, in the grain formation stage and the chemical ripening stage or the period after the completion of chemical ripening, or before or in the stage of chemical ripening and in the period after the completion of chemical ripening. Further, in such separate additions, different compounds or combinations with different compounds may be used respectively.

The added amount of the compound(s) of the present invention or sensitizing dye(s) used in the present invention, though depend on the shape and size of emulsion grains, is within the range of $1\times10^{-6}$ to $10\times10^{-3}$ mole per mole of silver halide. When the grain size of silver halide is from 0.2 to 1.3 $\mu$m, for instance, their addition amount is preferably from $2\times10^{-6}$ to $8\times10^{-3}$ mole, particularly preferably from $7.5\times10^{-6}$ to $6\times10^{-3}$ mole, per mole of silver halide.

The suitable ratio between the amount of present compounds added and the amount of sensitizing dyes added is from 100:1 to 1:1,000, preferably from 1:1 to 1:500, particularly preferably from 1:10 to 1:500.

A silver halide emulsion is in general chemically sensitized before use. As chemical sensitization, chalcogen sensitization (sulfur sensitization, selenium sensitization, tellurium sensitization), noble metal sensitization (gold sensitization) and reduction sensitization are used alone or in combination.

In sulfur sensitization, labile sulfur compounds are used as a sensitizer. Labile sulfur compounds are disclosed in P. Glafkides, *Chimie et Physique Photographique*, 5th Ed., Paul Montel (1987) and *Research Disclosure*, Vol. 307, No. 307105. Examples of sulfur sensitizers include thiosulfates (e.g., hypo), thioureas (e.g., diphenylthiourea, triethylthiourea, N-ethyl-N'-(4-methyl-2-thiazolyl) thiourea, carboxy-methyltrimethylthiourea), thioamides (e.g., thioacetamide), rhodanines (e.g., diethyl rhodanine, 5-benzylidene-N-ethyl rhodanine), phosphine sulfides (e.g., trimethylphosphine sulfide), thiohydantoins, 4-oxooxazolidine-2-thiones, dipolysulfides (e.g., dimorpholine disulfide, cystine, hexathiocanethione), mercapto compounds (e.g., cysteine), polythionate, and elemental sulfur. Active gelatins can also be used as a sulfur sensitizer.

In selenium sensitization, labile selenium compounds are used as a sensitizer. Labile selenium compounds are disclosed in JP-B-43-13489, JP-B-44-15748, JP-A-4-25832, JP-A-4-109240, JP-A-4-271341, and JP-A-5-40324. Examples of selenium sensitizers include colloidal metal selenium, selenoureas (e.g., N,N-dimethylselenourea, trifluoromethylcarbonyltrimethylselenourea, acetyltrimethylselenourea), selenoamides (e.g., selenoacetamide, N,N-diethylphenylselenoamide), phosphineselenides (e.g., triphenylphosphineselenide, pentafluorophenyltriphenylphosphineselenide), selenophosphates (e.g., tri-p-tolylselenophosphate, tri-n-butylselenophosphate), seleno ketones (e.g., selenobenzophenone), isoselenocyanates, selenocarboxylic acids, seleno esters, and diacylselenides. In addition, comparatively stable selenium compounds such as selenious acid, potassium selenocyanide, selenazoles and selenides (disclosed in JP-B-46-4553 and JP-B-52-34492) can also be used as a selenium sensitizer.

Labile tellurium compounds are used as a tellurium sensitizer in tellurium sensitization. Labile tellurium compounds are disclosed in Canadian Patent 800,958, British Patent 1,295,462, 1,396,696, JP-A-4-204640, JP-A-4-271341, JP-A-4-333043, and JP-A-5-303157. Examples of tellurium sensitizers include telluroureas (e.g., tetramethyltellurourea, N,N'-dimethylethylenetellurourea, N,N'-diphenylethylenetellurourea), phosphinetellurides (e.g., butyldiisopropylphosphinetelluride, tributylphosphinetelluride, tributoxyphosphinetelluride, ethoxydiphenylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis-(ethoxycarbonyl)telluride), isotellurocyanatos, telluroamides, tellurohydrazides, telluro esters (e.g., butylhexyltelluro ester), telluro ketones (e.g., telluroacetophenone), colloidal tellurium, (di)tellurides, and other tellurium compounds (e.g., potassium telluride, sodium telluropentathionate).

In noble metal sensitization, noble metal salts of gold, platinum, palladium, and iridium are used as a sensitizer. Noble metal salts are disclosed in P. Glafkides, *Chimie et Physique Photographique*, 5th Ed., Paul Montel (1987) and *Research Disclosure*, Vol. 307, No. 307105. Gold sensitization is particularly preferred. As described above, the effect of the present invention is particularly exhibited in the mode of conducting gold sensitization.

There are disclosed in *Photographic Science and Engineering*, Vol. 19322 (1975) and *Journal of Imaging Science*, Vol. 3228 (1988) that gold can be removed from the sensitization speck on an emulsion grain using a solution containing potassium cyanide (KCN). According to these descriptions, a cyanogen ion makes a gold atom or a gold ion adsorbed onto a silver halide grain isolate as a cyanogen complex to hinder gold sensitization. The action of gold sensitization can be sufficiently obtained by suppressing the occurrence of cyanogen according to the present invention.

Examples of gold sensitizers include chloroauric acid, potassium chloroaurate, potassium aurithiocyanate, gold sulfide, and gold selenide, as well as gold compounds disclosed in U.S. Pat. Nos. 2,642,361, 5,049,484 and 5,049,485.

Reducing compounds are used as a sensitizer in reduction sensitization. Reducing compounds are disclosed in P. Glafkides, *Chimie et Physique Photographique*, 5th Ed., Paul Montel (1987), and *Research Disclosure*, Vol. 307, No. 307105. Examples of reducing compounds include aminoiminomethanesulfinic acid (thiourea dioxide), borane compounds (e.g., dimethylamineborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfite, aldehyde compounds, and hydrogen gas. Reduction sensitization can be carried out in the atmosphere of high pH and excessive silver ion (so-called silver ripening).

Chemical sensitization may be conducted in combination of two or more. A combination of chalcogen sensitization with gold sensitization is particularly preferred. Reduction sensitization is preferably conducted during silver halide grain formation. The use amount of a sensitizer is in general determined according to the kind of silver halide grains to be used and the conditions of chemical sensitization.

The use amount of a chalcogen sensitizer is generally from $10^{-8}$ to $10^{-2}$ mol, preferably from $10^{-7}$ to $5\times10^{-3}$ mol, per mol of the silver halide.

The use amount of a noble metal sensitizer is preferably from $10^{-7}$ to $10^{-2}$ mol per mol of the silver halide.

The conditions of chemical sensitization are not particularly limited. pAg is in general from 6 to 11, preferably from 7 to 10, pH is preferably from 4 to 10, and temperature is preferably from 40 to 95° C., and more preferably from 45 to 85° C.

Various compounds can be added to a silver halide emulsion for preventing generation of fog or stabilizing photographic capabilities during production, storage or processing of a photographic material. Examples of such compounds include azoles (e.g., benzothiazolium salt, nitroindazoles, triazoles, benzotriazoles, benzimidazoles (in particular, nitro- or halogen-substituted); heterocyclic mercapto compounds (e.g., mercaptothiazoles, mercaptobenzothiazoles, mercaptobenzimidazoles, mercaptothiadiazoles, mercaptotetrazoles (in particular, 1-phenyl-5-mercaptotetrazoles) mercaptopyrimidines); the above heterocyclic mercapto compounds having a water-soluble group such as a carboxyl group or a sulfone group; thioketo compounds (e.g., oxazolinethione); azaindenes (e.g., tetraazaindenes (in particular, 4-hydroxy-substituted-(1,3,3a,7)tetraazaindene)); benzenethiosulfonic acid; and benzenesulfinic acid. These compounds are in general known as antifoggants or stabilizers.

Antifoggants or stabilizers are, in general, added after chemical sensitization. However, they may be added during chemical sensitization or before start of chemical sensitization. That is, they can be added at any time during silver halide emulsion grain forming process, e.g., during addition of a silver salt solution, during the period after addition and before start of chemical sensitization, or during chemical sensitization (preferably within the time up to 50% from the start, more preferably within the time up to 20%).

Various color couplers can be used in the present invention, and specific examples are disclosed in the patents cited in the above *Research Disclosure*, No. 17643, VII-C to G and ibid., No. 307105, VII-C to G. Non-diffusible couplers having a hydrophobic group called a ballast group or polymerized couplers are preferably used. Couplers may be either 2-equivalent or 4-equivalent to the silver ion. Colored couplers which have the effect of correcting colors or couplers which release development inhibitors upon development reaction (so-called DIR couplers) may be contained. Further, colorless DIR coupling compounds which produce a colorless coupling reaction product and release a development inhibitor may be contained.

Examples of preferred cyan couplers for use in the present invention include, e.g., naphthol based couplers and phenol based couplers, and preferred are those disclosed in U.S. Pat. Nos. 2,369,929, 2,772,162, 2,801,171, 2,895,826, 3,446,622, 3,758,308, 3,772,002, 4,052,212, 4,126,396, 4,146,396, 4,228,233, 4,254,212, 4,296,199, 4,296,200, 4,327,173, 4,333,999, 4,334,011, 4,343,011, 4,427,767, 4,451,559, 4,690,889, 4,775,616, West German Patent Publication No. 3,329,729, EP-A-121365, EP-A-249453, and JP-A-61-42658.

As magenta couplers, imidazo[1,2-b]pyrazoles disclosed in U.S. Pat. No. 4,500,630 and pyrazolo[1,5-b][1,2,4]triazoles disclosed in U.S. Pat. No. 4,540,654 are particularly preferably used. Other preferred magenta couplers include pyrazolotriazole couplers in which a branched alkyl group is directly bonded to the 2-, 3- or 6-position of the pyrazolotriazole ring disclosed in JP-A-61-65245, pyrazoloazole couplers having a sulfonamido group in the molecule disclosed in JP-A-61-65246, pyrazoloazole couplers having an alkoxyphenylsulfonamido ballast group disclosed in JP-A-61-147254, and pyrazolotriazole couplers having an alkoxyl group or an aryloxy group at the 6-position disclosed in European Patents (Publication) 226849 and 294785, in addition, couplers disclosed in U.S. Pat. Nos. 3,061,432, 3,725,067, 4,310,619, 4,351,897, 4,556,630, European Patent 73636, JP-A-55-118034, JP-A-60-35730, JP-A-60-43659, JP-A-60-185951, JP-A-61-72238, WO 88/04795, *Research Disclosure*, No. 24220 and ibid. No. 24230 are more preferably used.

Preferred yellow couplers are those disclosed, for example, in U.S. Pat. Nos. 3,933,501, 3,973,968, 4,022,620; 4,248,961, 4,314,023, 4,326,024, 4,401,752, 4,511,649, EP-A-249473, JP-B-58-10739, British Patents 1,425,020, and 1,476,760, and the use of pivaloylacetanilide is more preferred.

The above-described couplers which can be preferably used in the present invention are the same as those disclosed in detail in JP-A-2-248945 as preferred couplers, and as specific examples of the above couplers which can preferably be used in the present invention, specific examples of couplers disclosed in JP-A-2-248945, pp. 22 to 29 can be cited.

Typical examples of polymerized dye-forming couplers are disclosed in U.S. Pat. Nos. 3,451,820, 4,080,211, 4,367,282, 4,409,320, 4,576,910, EP-A-341188 and British Patent 2,102,137 and they are more preferably used.

The couplers disclosed in U.S. Pat. No. 4,366,237, European Patent 96570, British Patent 2,125,570, and West German Patent Publication No. 3,234,533 are preferred as couplers the colored dyes of which have an appropriate diffusibility.

The preferred colored couplers for correcting the unnecessary absorption of colored dyes are disclosed in the patents described in *Research Disclosure*, No. 17643, item VII-G, ibid., No. 307105, item VII-G, U.S. Pat. Nos. 4,004,929, 4,138,258, 4,163,670, British Patent 1,146,368, and JP-B-57-39413. Moreover, it is also preferred to use couplers for correcting the unnecessary absorption of colored dyes by fluorescent dyes released upon coupling disclosed in U.S. Pat. No. 4,774,181, and couplers having a dye precursor group capable of forming a dye upon reacting with a developing agent as a releasable group disclosed in U.S. Pat. No. 4,777,120.

Compounds which release photographically useful residual groups upon coupling can also preferably be used in the present invention. The preferred DIR couplers which release development inhibitors are disclosed in the patents cited in the foregoing *Research Disclosure*, No. 17643, item VII-F, ibid., No. 307105, item VII-F, JP-A-57-151944, JP-A-57-154234, JP-A-60-184248, JP-A-63-37346, JP-A-63-37350, U.S. Pat. Nos. 4,248,962 and 4,782,012.

Couplers disclosed in JP-A-59-157638, JP-A-59-170840, British Patents 2,097,140, and 2,131,188 are preferred as couplers which imagewise release nucleating agents or development accelerators at the time of development. Further, compounds which release fogging agents, development accelerators, silver halide solvents, etc., upon oxidation reduction reaction with the oxidation products of developing agents disclosed in JP-A-60-107029, JP-A-60-252340, JP-A-1-44940 and JP-A-1-45687 are also preferred.

Other compounds which can be used in the photographic material of the present invention include competitive couplers disclosed in U.S. Pat. No. 4,130,427, multiequivalent couplers disclosed in U.S. Pat. Nos. 4,283,472, 4,338,393 and 4,310,618, DIR redox compound-releasing couplers, DIR coupler-releasing couplers, DIR coupler-releasing redox compounds or DIR redox-releasing redox compounds disclosed in JP-A-60-185950 and JP-A-62-24252, couplers which release dyes which restore colors after separation disclosed in EP-A-173302 and EP-A-313308, bleaching accelerator-releasing couplers disclosed in the patents cited in *Research Disclosure*, No. 11449, ibid., No. 24241 and JP-A-61-201247, ligand-releasing couplers disclosed in U.S. Pat. No. 4,553,477, leuco dye-releasing couplers disclosed in JP-A-63-75747, and fluorescent dye-releasing couplers disclosed in U.S. Pat. No. 4,774,181.

Two or more of the above couplers, etc., can be used in combination in the same layer for satisfying the characteristics required of the photographic material, or, of course, the same compound can be added to two or more different layers.

The above couplers are contained in a silver halide photographic emulsion layer which constitutes a light-sensitive layer generally in an amount of from 0.1 to 1.0 mol, preferably from 0.1 to 0.5 mol, per mol of the silver halide.

In the present invention, various known methods can be used to incorporate the above couplers into a light-sensitive layer. In general, an oil-in-water dispersing method known as an oil-protect method is effectively used for the addition. That is, the coupler is dissolved in a solvent, then dispersed in an aqueous solution of gelatin containing a surfactant. Alternatively, couplers may be added as oil-in-water dispersion accompanied by phase inversion by adding water or an aqueous solution of gelatin to a coupler solution containing a surfactant. In addition, alkali-soluble couplers can be dispersed according to a so-called Fischer dispersing method. After a low boiling point organic solvent is removed from the coupler dispersion by distillation, noodle washing or ultrafiltration, couplers may be mixed with a photographic emulsion.

As a dispersion medium of couplers, it is preferred to use a high boiling point organic solvent having a dielectric constant of from 2 to 20 at 25° C. and a refractive index of from 1.5 to 1.7 at 25° C. and/or a water-insoluble high molecular compound. Such solvents as disclosed in the above JP-A-2-248945, p. 30 are preferably used as a high boiling point organic solvent. Compounds which have a melting point of 100° C. or less, a boiling point of 140° C. or more, are immiscible with water, and are good solvents to couplers can be used. A melting point of a high boiling point organic solvent is preferably 80° C. or less and a boiling point is preferably 160° C. or more, more preferably 170° C. or more.

These high boiling point organic solvents are disclosed in detail in JP-A-62-215272, p. 137 right lower column to p. 144, right upper column.

These couplers can be dispersed in a hydrophilic colloidal aqueous solution in an emulsified state by impregnating in a loadable latex polymer (e.g., disclosed in U.S. Pat. No. 4,203,716) in the presence (or absence) of the above high boiling point organic solvents, or by dissolving in a polymer insoluble in water but soluble in an organic solvent. Homopolymers or copolymers disclosed in WO 88/00723, from pages 12 to 30 are preferably used as such polymers insoluble in water but soluble in an organic solvent, in particular, acrylamide based polymers are preferred in view of dye image stability.

The following compounds are particularly preferably used in combination with the above couplers.

That is, the use of a compound which produces a chemically inactive and substantially colorless compound upon chemically bonding with an aromatic amine developing agent remaining after color development and/or a compound which produces a chemically inactive and substantially colorless compound upon chemically bonding with the oxidized product of an aromatic amine color developing agent remaining after color development, alone or in combination, is preferred for preventing the generation of stain due to the formation of a colored dye caused by the coupling reaction of the coupler with the color developing agent or the oxidized product thereof remaining in the film, or preventing other side reactions, during preservation after processing. Such compounds and desired conditions are disclosed in detail in JP-A-2-248945, pp. 31 and 32, and as preferred specific examples of the former, compounds disclosed in JP-A-63-158545, JP-A-62-283338, JP-A-64-2042, European Patents 277589 and 298321 can be mentioned, and as preferred specific examples of the latter, compounds disclosed in JP-A-62-143048, JP-A-62-229145, European Patent 255722, JP-A-64-2042, JP-A-1-57259, JP-A-1-230039, European Patents 277589 and 298321 can be cited. Further, combinations of the former and the latter are disclosed in European Patent 277589.

Silver halide emulsion layers and/or other hydrophilic colloid layers of the silver halide photographic material containing the emulsion according to the present invention may contain dyes for the purpose of increasing image sharpness and safelight safety or preventing color mixing. Such dyes may be added to the layer in which the emulsion is contained or not contained but are preferably fixed in a specific layer. For that purpose, dyes are included in colloid layers in a nondiffusible state and used so as to be decolored during the course of development processing. In the first place, a fine grain dispersion of a dye which is substantially insoluble in water having pH 7 and soluble in water of pH 7 or more is used. Secondly, an acidic dye is used together with a polymer or a polymer latex having a cation site. Dyes represented by formulae (VI) and (VII) disclosed in JP-A-63-197947 are useful in the first and second methods, in particular, the dye having a carboxyl group is effective in the first method.

It is preferred for the photographic material of the present invention to contain phenethyl alcohol and various antiseptics or biocides, e.g., 1,2-benzisothiazolin-3-one, n-butyl-p-hydroxybenzoate, phenol, 4-chloro-3,5-dimethylphenol, 2-phenoxyethanol, 2-(4-thiazolyl)benzimidazole, etc., disclosed in JP-A-62-272248, JP-A-63-257747 and JP-A-1-80941.

There is no particular limitation on other additives for use in the photographic material of the present invention and, for example, disclosures in *Research Disclosure*, Vol. 176, Item 17643 (RD 17643), ibid., Vol. 187, Item 18716 (RD 18716) and ibid., Vol. 308, Item 308119 (RD 308119) can be referred to.

The locations related to various additives in RD 17643, RD 18716 and RD 308119 are indicated in the following table.

| Type of Additives | RD 17643 | RD 18716 | RD 308119 |
|---|---|---|---|
| 1. Chemical Sensitizers | page 23 | page 648, right column | page 996 |
| 2. Sensitivity Increasing Agents | | page 648, right column | |
| 3. Spectral Sensitizers and Supersensitizers | pages 23–24 | page 648, right column to page 649, right column | page 996, right column to page 998 right column |
| 4. Brightening Agents | page 24 | | page 998, right column |
| 5. Antifoggants and Stabilizers | pages 24–25 | page 649, right column | page 998, right column to page 1000, right column |
| 6. Light Absorbers, Filter Dyes, and Ultraviolet Absorbers | pages 25–26 | page 649, right column to page 650, left column | page 1003, left column to page 1003, right column |
| 7. Antistaining Agents | page 25, right column | page 650, left to right columns | page 1002, right column |
| 8. Dye image Stabilizers | page 25 | | page 1002, right column |
| 9. Hardening Agents | page 26 | page 651, left column | page 1004, right column to page 1005, left column |
| 10. Binders | page 26 | page 651, left column | page 1003, right column to page 1004, right column |
| 11. Plasticizers and Lubricants | page 27 | page 650, right column | page 1006, left column to page 1006 right column |
| 12. Coating Aids and Surfactants | pages 26–27 | page 650, right column | page 1005, left column to page 1006, left column |
| 13. Antistatic Agents | page 27 | page 650, right column | page 1006, right column to page 1007, left column |
| 14. Matting Agents | | | page 1008, left column |

The photographic material of the present invention can be applied, for example, to black-and-white and color negative films for photographing (for general and cinematographic uses), color reversal films (for slide and cinematographic uses), black-and-white and color photographic papers, color positive films (for cinematographic use), color reversal photographic papers, black-and-white and color heat-developable photographic materials, black-and-white and color photographic materials for plate making (lith films and scanner films, etc.), black-and-white and color photographic materials for medical and industrial uses, black-and-white and color diffusion transfer photographic materials (DTR), etc., and particularly preferably used as color papers.

Proper supports which can be used in the present invention are disclosed, for example, in RD, No. 17643, p. 28, ibid., No. 18716, p. 647, right column to p. 648, left column, and ibid., No. 307105, p. 879.

In the photographic processing of photographic materials using the present invention, any known method can be used and any known processing solution can be used. The processing temperature is selected generally between 18° C. and 50° C. but temperatures lower than 18° C. or higher than 50° C. are available. According to purposes, both development processing for forming a silver image (black-and-white photographic processing) and color photographic processing comprising development processing for forming a dye image can be applied.

In a black-and-white developing solution, known developing agents such as dihydroxybenzenes (e.g., hydroquinone), 3-pyrazolidones (e.g., 1-phenyl-3-pyrazolidone), aminophenols (e.g., N-methyl-p-aminophenol) and the like can be used alone or in combination.

A color developing solution, in general, comprises an alkaline aqueous solution containing a color developing agent.

As a color developing agent, conventionally known aromatic primary amine color developing agents can be used, for example, phenylenediamines (e.g., 4-amino-N-diethylaniline, 4-amino-3-methyl-N,N-diethylaniline, 4-amino-N-ethyl-N-β-hydroxyethylaniline, 4-amino-3-methyl-N-ethyl-N-β-hydroxyethylaniline, 4-amino-3-methyl-N-ethyl-N-β-methane-sulfonylaminoethylaniline, 4-amino-3-methyl-N-ethyl-N-β-methoxyethylaniline).

In addition to the above, those disclosed in L. F. A. Mason, *Photographic Processing Chemistry*, Focal Press, pp. 226 to 229 (1966), U.S. Pat. Nos. 2,193,015, 2,592,364, and JP-A-48-64933 may be used. A developing solution can contain a pH buffer such as alkali metal sulfite, carbonate, borate and phosphate, or a development inhibitor or an antifoggant such as bromide, iodide, and an organic antifoggant. A developing solution may also contain, if necessary, a hard water softener, a preservative such as hydroxylamine, an organic solvent such as benzyl alcohol and diethylene glycol, a development accelerator such as polyethylene glycol, quaternary ammonium salt, and amines, a dye-forming coupler, a competitive coupler, a fogging agent such as sodium boronhydride, an auxiliary developing agent such as 1-phenyl-3-pyrazolidone, a thickener, the polycarboxylic acid chelating agent disclosed in U.S. Pat. No. 4,083,723, or the antioxidant disclosed in West German Patent (OLS) No. 2,622,950.

When color photographic processing is conducted, a photographic material is generally bleaching processed after being color development processed. A bleaching process and a fixing process may be carried out at the same time or may be performed separately. Compounds of polyvalent metals such as iron(III), cobalt(III), chromium(IV), copper(II), etc., peracids, quinones, and nitroso compounds are used as a bleaching agent. For example, bleaching agents which can be used include a complex salt such as an organic complex salt of ferricyanide, bichromate, iron(III) or cobalt(III) with aminopolycarboxylic acids, e.g., ethylenediaminetetraacetic acid, nitrilotriacetic acid, and 1,3-diamino-2-propanoltetraacetic acid, or a complex salt of organic acid such as citric acid, tartaric acid, and malic acid, or persulfate, permanganate or nitrosophenol. The use of potassium ferricyanide, sodium ethylenediaminetetraacetic acid iron (III) complex salt and ammonium ethylenediaminetetraacetic acid iron(III) complex salt is preferred above all. Ethylenediaminetetraacetic acid iron(III) complex salt is useful in a bleaching solution or a monobath blixing solution.

A bleaching solution of a blixing solution can contain various additives as well as thiol compounds disclosed in U.S. Pat. Nos. 3,042,520, 3,241,966, JP-B-45-8506, and JP-B-45-8836. Further, the photographic material of the present invention may be subjected to washing process or may be processed with a stabilizing solution without employing a washing step after bleaching or blixing step.

The present invention is preferably applied to a silver halide photographic material having a transparent magnetic recording layer. The polyester laminar supports which have been previously heat-treated as disclosed in detail in JP-A-6-35118, JP-A-6-17528, and Hatsumei-Kyokai Kokai Giho No. 94-6023, e.g., polyethylene aromatic dicarboxylate based polyester supports, having a thickness of from 50 to 300 μm, preferably from 50 to 200 μm, more preferably from 80 to 115 μm, and particularly preferably from 85 to 105 μm. annealed at 40° C. or more and the glass transition point temperature or less for from 1 to 1,500 hours, are preferably used for silver halide photographic materials having a magnetic recording layer for use in the present invention. The above-described supports can be subjected to a surface treatment such as an ultraviolet irradiation treatment as disclosed in JP-B-43-2603, JP-B-43-2604 and JP-B-45-3828, a corona discharge treatment as disclosed in JP-B-48-5043 and JP-A-51-131576, and a glow discharge treatment as disclosed in JP-B-35-7578 and JP-B-46-43480, undercoated as disclosed in U.S. Pat. No. 5,326,689, provided with an underlayer as disclosed in U.S. Pat. No. 2,761,791, if necessary, and coated with ferromagnetic particles as disclosed in JP-A-59-23505, JP-A-4-195726 and JP-A-6-59357.

The above-described magnetic layer may be provided on a support in stripe as disclosed in JP-A-4-124642 and JP-A-4-124645.

Further, the supports are subjected to an antistatic treatment, if necessary, as disclosed in JP-A-4-62543, and finally silver halide photographic emulsion are coated. The silver halide photographic emulsions disclosed in JP-A-4-166932, JP-A-3-41436 and JP-A-3-41437 are used herein.

The photographic material to be produced in this way is preferably manufactured according to the manufacturing and controlling methods as disclosed in JP-B-4-86817 and manufacturing data are recorded according to the methods disclosed in JP-B-6-87146. Before or after that, according to the methods disclosed in JP-A-4-125560, the photographic material is cut to a film of a narrower width than that of a conventional 135 size film and two perforations are made on one side per a smaller format picture plane so as to match with the smaller format picture plane than the picture plane heretofore in use.

The thus-produced film can be loaded and used in the cartridge packages disclosed in JP-A-4-157459, the cartridge disclosed in FIG. 9 in Example of JP-A-5-210202, the film patrones disclosed in U.S. Pat. No. 4,221,479, or the cartridges disclosed in U.S. Pat. Nos. 4,834,306, 4,834,366, 5,226,613 and 4,846,418.

Film cartridges and film patrones of the type which can encase a film tip as disclosed in U.S. Pat. Nos. 4,848,693 and 5,317,355 are preferred in view of the light shielding capability.

Further, a cartridge which has a locking mechanism as disclosed in U.S. Pat. No. 5,296,886, a cartridge which has the displaying function of working conditions, and a cartridge which has the function of preventing double exposure as disclosed in U.S. Pat. No. 5,347,334 are preferred.

In addition, a cartridge by which a film can be easily loaded only by inserting a film into a cartridge as disclosed in JP-A-6-85128 may be used.

The thus-produced film cartridges can be used for various photographic pleasures such as photographing and development processing using the following cameras, developing machines, and laboratory devices according to purposes.

The functions of film cartridges (patrones) can be sufficiently demonstrated using, for example, the easily loadable camera disclosed in JP-A-6-8886 and JP-A-6-99908, the automatic winding type camera disclosed in JP-A-6-57398 and JP-A-6-101135, the camera capable of pulling out the film and exchanging for a different kind of film in the course of photographing disclosed in JP-A-6-205690, the camera which can magnetically record the information at photographing time such as panorama photographing, high vision photographing or general photographing (capable of magnetic recording which can set up the print aspect ratio) disclosed in JP-A-5-293138 and JP-A-5-283382, the camera having the function of preventing double exposure disclosed in JP-A-6-101194, and the camera having the displaying function of working conditions of a film and the like disclosed in JP-A-5-150577.

The thus-photographed films may be processed using the automatic processors disclosed in JP-A-6-222514 and JP-A-6-212545, the using methods of the magnetic recording information on the film disclosed in JP-A-6-95265 and JP-A-4-123054 may be used before, during or after processing, or the function of selecting the aspect ratio disclosed in JP-A-5-19364 can be used.

If development processing is motion picture type development, the film is processed by splicing according to the method disclosed in JP-A-5-119461.

Further, during and after development processing, the attachment and detachment disclosed in JP-A-6-148805 are conducted.

After processing has been conducted thus, the information on the film may be altered to a print through back printing and front printing to a color paper according to the methods disclosed in JP-A-2-184835, JP-A-4-186335 and JP-A-6-79968.

The film may be returned to a customer with the index print disclosed in JP-A-5-11353 and JP-A-5-232594 and the return cartridge.

Now, the present invention will be illustrated below in detail by reference to the following examples, but it should be understood that these examples are not to be construed as limiting the scope of the invention in any way.

EXAMPLE 1

Making Emulsion 1-A (Emulsion comprising very thin tabular silver iodobromide grains)

According to the flowchart shown in FIG. 2, tabular grains are formed using a mixing vessel (inside volume: 2 cc) shown in FIG. 1 in the manner described below.

In the reaction vessel 1, 1.0 liter of water and 2 g of low molecular ossein gelatin (average molecular weight: 10,000) were placed, and kept at 35° C. to make a solution. Into the mixing vessel 10, 50 cc of a 0.6 M aqueous solution of silver nitrate and 200 cc of a 0.16 M aqueous solution of KBr in which 0.8 weight % of low molecular gelatin was dissolved were fed over a period of 2 minutes, and the emulsion obtained was added continuously to the reaction vessel over a period of 2 minutes. Therein, the number of revolutions of a stirring blade arranged in the mixing vessel was 2,000 rpm. (Thus, nucleation was effected.)

To the reaction vessel, 300 cc of a 10% solution of oxidized ossein gelatin (methionine content: 5 $\mu$mol/g) and KBr were added so that the emulsion in the reaction vessel had the pBr 2.1, and then the temperature was raised up to 85° C. (Thus, ripening was performed.)

Thereafter, 600 cc of a 1.0 M aqueous solution of silver nitrate, 600 cc of a 0.98 M aqueous solution of KBr in which 3 mole % of KI was contained and 800 cc of a 5% aqueous solution of low molecular gelatin were fed again into the mixing vessel in an increasing flow rate. Herein, the flow rate at the end of the addition was 4 times the flow rate at the beginning of the addition. The fine grains formed in the mixing vessel were added continuously to the reaction vessel. Therein, the mixing vessel was stirred at 2,000 rpm.

At the time when 70% of silver nitrate had been added in the course of grain growth, $8\times10^{-8}$ mole/mole Ag of $IrCl_6$ was added to dope the grains. Further, hexacyanoferrate (II) was added to the mixing vessel before the completion of the grain growth. Thus, 3% of the shell part (on a basis of silver added) in each grain was doped with the hexacyanoferrate (II) in a localized concentration of $3\times10^{-4}$ mole/mole Ag. After the addition was completed, the emulsion was cooled to 35° C., washed using a conventional flocculation method, admixed with 70 g of lime-processed ossein gelatin, adjusted to pAg 8.7 and pH 6.5, and stored at a cool and dark place.

The emulsion grains obtained were monodisperse very thin tabular grains having a projected area diameter of 2.3 $\mu$m, an average thickness of 0.045 $\mu$m, an average aspect ratio of 51 and a variation coefficient of 16% with respect to the projected area diameter. Herein, the term "projected area diameter" as used herein means the diameter of a circle having the same area as the projected area of a tabular grain, and the term "variation coefficient" is defined as the value given by a standard deviation of projected area diameters being divided by an average projected area diameter and then multiplied by 100.

Making Emulsion 1-B (Emulsion comprising tabular silver iodobromide grains)

In the reaction vessel 1, 1.0 liter of water, 3 g of low molecular ossein gelatin (average molecular weight: 20,000) and 0.5 g of KBr were placed, and kept at 40° C. to make a solution. Thereto, 10 cc of a 0.5 M aqueous solution of silver nitrate and 20 cc of a 0.3 M aqueous solution of KBr were added over a period of 40 seconds, and further 22 cc of a 0.8 M KBr solution was added. Then, the resulting emulsion was ripened by 5 minutes' heating at 75° C. Thereto was added 300 cc of a 10 weight % aqueous solution of lime-processed ossein gelatin. Furthermore, 800 cc of a 1.5 M aqueous solution of silver nitrate and 800 cc of a 1.5 M aqueous solution of KBr in which 3 mole % of KI was contained were added over a period of 60 minutes while keeping the temperature of the reaction vessel at 75° C.

At the time when 70% of silver nitrate had been added in the course of grain growth, $8\times10^{-8}$ mole/mole Ag of $IrCl_6$ was added to dope the grains. Further, hexacyanoferrate (II) was added to the reaction vessel before the completion of the grain growth. Thus, 3% of the shell part (on a basis of silver added) in each grain was doped with the hexacyanoferrate (II) in a localized concentration of $3\times10^{-4}$ mole/mole Ag. After the addition was completed, the emulsion was cooled to 35° C., washed according to a conventional flocculation method, admixed with 70 g of lime-processed ossein gelatin, adjusted to pAg 8.7 and pH 6.5, and stored at a cool and dark place.

The emulsion grains obtained were monodisperse tabular grains having a projected area diameter of 1.1 $\mu$m, an average thickness of 0.19 $\mu$m. an average aspect ratio of 6 and a variation coefficient of 15% with respect to the projected area diameter.

The tabular grains comprised in Emulsion 1-A and those in Emulsion 1-B had almost the same grain volume, but the per grain surface area of the grains in Emulsion 1-A was about 3.2 times as large as that of the grains in Emulsion 1-B.

To each of Emulsions 1-A and 1-B, the compound relating to the present invention or/and the sensitizing dye shown in Tables 1, 2, 3 or 4 was(were) added in the amount(s) as set forth in Table 1, 2, 3 or 4, and stirred for 10 minutes at 40° C. The resulting emulsions were each heated to 60° C. and chemically sensitized with sodium thiosulfate, potassium chloroaurate and potassium thiocyanate so as to acquire the optimum sensitivity.

On a cellulose triacetate film support provided with a subbing layer, an emulsion layer and a protective layer having the following compositions respectively were coated to prepare emulsion-coated samples.

| | |
|---|---|
| (1) Composition of Emulsion Layer: | |
| Emulsion shown in Tables 1 to 4 | $3.6 \times 10^{-2}$ mole/m$^2$ based on silver |
| Coupler illustrated below | $1.5 \times 10^{-3}$ mole/m$^2$ |

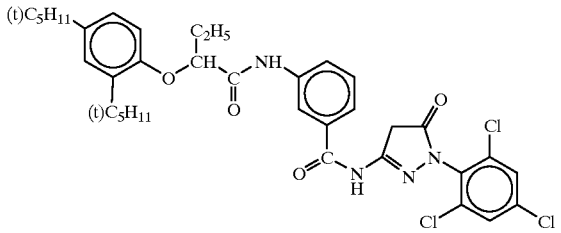

| | |
|---|---|
| Tricresyl phosphate | 1.10 g/m$^2$ |
| Gelatin | 2.30 g/m$^2$ |
| (2) Composition of Protective Layer: | |
| Sodium salt of 2,4-dichloro-6-hydroxy-s-triazine | |
| Gelatin | 1.80 g/m$^2$ |

Each of the thus prepared samples was allowed to stand for 14 hours under a condition of 40° C.–70% RH, exposed to light for 1/100 second via a continuous wedge, and then subjected to the following color photographic processing.

[Color Photographic Processing]

| Step | Time | Temperature |
|---|---|---|
| Color development | 2 min. 00 sec. | 40° C. |
| Bleach-fix | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The composition of each processing solution used is described below:

| Color Developer | |
|---|---|
| Diethylenetriaminepentaacetic acid | 2.0 g |
| 1-Hydroxyethylidene-1, 1-disulfone | 4.0 g |
| Sodium sulfite | |
| Potassium carbonate | 30.0 g |
| Potassium bromide | 1.4 g |
| Potassium iodide | 1.5 mg |
| Hydroxylamine sulfate | 2.4 g |
| 4-[N-Ethyl-N-β-hydroxyethylamino]-2-methyl-aniline sulfate | 4.5 g |
| Water to make | 1.0 liter |
| pH adjusted to | 10.05 |

| Bleach-Fix Bath | |
|---|---|
| Ammonium-(ethylenediaminetetraacetato)-iron(III) complex dihydrate | 90.0 g |
| Disodium ethylenediaminetetraacetate | 5.0 g |
| Sodium sulfite | 12.0 g |
| Ammonium thiosulfate (70% aq. soln.) | 260.0 ml |
| Acetic acid (98%) | 5.0 ml |
| Bleach accelerator illustrated below | 0.01 mol |

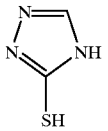

| | |
|---|---|
| Water to make | 1.0 liter |
| pH adjusted to | 6.0 |

Washing Bath

City water was passed through a mixed-bed column packed with an H-type cation exchange resin (Amberlite IR-120B, produced by Rohm & Haas Co.) and an OH-type anion exchange resin (Amberlite IR-400, produced by Rohm & Hass Co.) to reduce calcium and magnesium concentrations each to 3 mg/l or below, and then admixed with 20 mg/l of sodium dichloroisocyanurate and 1.5 g/l of sodium sulfate. The pH of the resulting water was in the range of 6.5 to 7.5.

| Stabilizing Bath: | |
|---|---|
| Formaldehyde (37%) | 2.0 ml |
| Polyoxyethylene-p-monononylphenylether (average polymerization degree: 10) | 0.3 g |
| Disodium ethylenediaminetetraacetate | 0.05 g |
| Water to make | 1.0 liter |
| pH adjusted to | 5.0–8.0 |

The optical densities of the thus processed films each were measured with a Fuji automatic densitometer. The fog of each sample was evaluated by the optical density in the unexposed area. The sensitivity of each sample was determined as the reciprocal of an exposure amount (expressed in luxsec) required for providing the density of fog+0.2, and shown as relative values, with Sample No. 101 being taken as 100 (standard). The results obtained are shown in Tables 1, 2, 3 and 4.

As can be seen from these tables, the sensitivity was increased by the use of compounds according to the present invention, and much greater increase in sensitivity was achieved by the use of tabular silver halide emulsion grains having a very high aspect ratio according to the present invention.

TABLE 1

| | | Sensitizing Dye | | | | | |
|---|---|---|---|---|---|---|---|
| | | Compound | | A- | | | |
| Sample No. | Emulsion | No. | Amount added (mol/mol Ag) | No. | mound Added (mol/mol Ag) | Sensitivity | Remarks |
| 101 | 1-B | — | — | — | — | 100 | Comparison |
| 102 | " | (SS-1) | $0.9 \times 10^{-4}$ | –" | " | 120 | " |

TABLE 1-continued

| Sample No. | Emulsion | Compound No. | Compound Amount added (mol/mol Ag) | Sensitizing Dye No. | Sensitizing Dye Amount Added (mol/mol Ag) | Sensitivity | Remarks |
|---|---|---|---|---|---|---|---|
| 103 | " | (62) | " | " | " | 191 | " |
| 104 | " | (1) | " | " | " | 201 | " |
| 105 | " | (SS-2) | " | " | " | 119 | " |
| 106 | " | (39) | " | " | " | 175 | " |
| 107 | " | (28) | " | " | " | 183 | " |
| 108 | " | (SS-3) | " | " | " | 118 | " |
| 109 | " | (63) | " | " | " | 172 | " |
| 110 | " | (40) | " | " | " | 178 | " |
| 111 | " | (SS-4) | " | " | " | 120 | " |
| 112 | " | (64) | " | " | " | 182 | " |
| 113 | " | (50) | " | " | " | 193 | " |
| 114 | 1-A | — | — | " | " | 160 | " |
| 115 | " | (SS-1) | $0.3 \times 10^{-3}$ | " | " | 180 | " |
| 116 | " | (62) | " | " | " | 410 | Invention |
| 117 | " | (1) | " | " | " | 423 | " |
| 118 | " | (SS-2) | " | " | " | 180 | Comparison |
| 119 | " | (39) | " | " | " | 390 | Invention |
| 120 | " | (28) | " | " | " | 400 | " |
| 121 | " | (SS-3) | " | " | " | 180 | Comparison |
| 122 | " | (63) | " | " | " | 380 | Invention |
| 123 | " | (40) | " | " | " | 395 | " |
| 124 | " | (SS-4) | " | " | " | 181 | Comparison |
| 125 | " | (64) | " | " | " | 401 | Invention |
| 126 | " | (50) | " | " | " | 411 | " |

TABLE 2

| Sample No. | Emulsion | Compound No. | Compound Amount added (mol/mol Ag) | Sensitizing Dye No. | Sensitizing Dye Amount Added (mol/mol Ag) | Sensitivity | Remarks |
|---|---|---|---|---|---|---|---|
| 201 | 1-B | — | — | (S-1) | $9 \times 10^{-4}$ | 301 | Comparison |
| 202 | " | (SS-1) | $0.9 \times 10^{-4}$ | –" | " | 321 | " |
| 203 | " | (62) | " | " | " | 591 | " |
| 204 | " | (1) | " | " | " | 601 | " |
| 205 | " | (SS-2) | " | " | " | 317 | " |
| 206 | " | (39) | " | " | " | 578 | " |
| 207 | " | (28) | " | " | " | 584 | " |
| 208 | " | (SS-3) | " | " | " | 316 | " |
| 209 | " | (63) | " | " | " | 570 | " |
| 210 | " | (40) | " | " | " | 575 | " |
| 211 | " | (SS-4) | " | " | " | 319 | " |
| 212 | " | (64) | " | " | " | 583 | " |
| 213 | " | (50) | " | " | " | 592 | " |
| 214 | 1-A | — | — | " | $3 \times 10^{-3}$ | 705 | " |
| 215 | " | (SS-1) | $0.3 \times 10^{-3}$ | " | " | 725 | " |
| 216 | " | (62) | " | " | " | 1698 | Invention |
| 217 | " | (1) | " | " | " | 1701 | " |
| 218 | " | (SS-2) | " | " | " | 721 | Comparison |
| 219 | " | (39) | " | " | " | 1675 | Invention |
| 220 | " | (28) | " | " | " | 1681 | " |
| 221 | " | (SS-3) | " | " | " | 715 | Comparison |
| 222 | " | (63) | " | " | " | 1664 | Invention |
| 223 | " | (40) | " | " | " | 1670 | " |
| 224 | " | (SS-4) | " | " | " | 724 | Comparison |
| 225 | " | (64) | " | " | " | 1683 | Invention |
| 226 | " | (50) | " | " | " | 1695 | " |

TABLE 3

| Sample No. | Emulsion | Compound No. | Compound Amount added (mol/mol Ag) | Sensitizing Dye No. | Sensitizing Dye Amound Added (mol/mol Ag) | Sensitivity | Remarks |
|---|---|---|---|---|---|---|---|
| 301 | 1-B | — | — | (S-2) | $9 \times 10^{-4}$ | 401 | Comparison |
| 302 | " | (SS-1) | $0.9 \times 10^{-4}$ | –" | " | 425 | " |
| 303 | " | (62) | " | " | " | 798 | " |
| 304 | " | (1) | " | " | " | 801 | " |
| 305 | " | (SS-2) | " | " | " | 423 | " |
| 306 | " | (39) | " | " | " | 483 | " |
| 307 | " | (28) | " | " | " | 788 | " |
| 308 | " | (SS-3) | " | " | " | 424 | " |
| 309 | " | (63) | " | " | " | 772 | " |
| 310 | " | (40) | " | " | " | 781 | " |
| 311 | " | (SS-4) | " | " | " | 424 | " |
| 312 | " | (64) | " | " | " | 790 | " |
| 313 | " | (50) | " | " | " | 799 | " |
| 314 | 1-A | — | — | " | $3 \times 10^{-4}$ | 903 | " |
| 315 | " | (SS-1) | $0.3 \times 10^{-4}$ | " | " | 933 | " |
| 316 | " | (62) | " | " | " | 2104 | Invention |
| 317 | " | (1) | " | " | " | 3110 | " |
| 318 | " | (SS-2) | " | " | " | 931 | Comparison |
| 319 | " | (39) | " | " | " | 2085 | Invention |
| 320 | " | (28) | " | " | " | 2090 | " |
| 321 | " | (SS-3) | " | " | " | 928 | Comparison |
| 322 | " | (63) | " | " | " | 2080 | Invention |
| 323 | " | (40) | " | " | " | 2082 | " |
| 324 | " | (SS-4) | " | " | " | 932 | Comparison |
| 325 | " | (64) | " | " | " | 2091 | Invention |
| 326 | " | (50) | " | " | " | 2103 | " |

TABLE 4

| Sample No. | Emulsion | Compound No. | Compound Amount added (mol/mol Ag) | Sensitizing Dye No. | Sensitizing Dye Amound Added (mol/mol Ag) | Sensitivity | Remarks |
|---|---|---|---|---|---|---|---|
| 401 | 1-B | — | — | (S-3) | $9 \times 10^{-4}$ | 392 | Comparison |
| 402 | " | (SS-1) | $0.9 \times 10^{-4}$ | –" | " | 420 | " |
| 403 | " | (62) | " | " | " | 790 | " |
| 404 | " | (1) | " | " | " | 797 | " |
| 405 | " | (SS-2) | " | " | " | 421 | " |
| 406 | " | (39) | " | " | " | 771 | " |
| 407 | " | (28) | " | " | " | 775 | " |
| 408 | " | (SS-3) | " | " | " | 420 | " |
| 409 | " | (63) | " | " | " | 768 | " |
| 410 | " | (40) | " | " | " | 772 | " |
| 411 | " | (SS-4) | " | " | " | 422 | " |
| 412 | " | (64) | " | " | " | 782 | " |
| 413 | " | (50) | " | " | " | 791 | " |
| 414 | 1-A | — | — | " | $0.3 \times 10^{-3}$ | 880 | " |
| 415 | " | (SS-1) | $0.3 \times 10^{-4}$ | " | " | 898 | " |
| 416 | " | (62) | " | " | " | 2095 | Invention |
| 417 | " | (1) | " | " | " | 2100 | " |
| 418 | " | (SS-2) | " | " | " | 897 | Comparison |
| 419 | " | (39) | " | " | " | 2080 | Invention |
| 420 | " | (28) | " | " | " | 2086 | " |
| 421 | " | (SS-3) | " | " | " | 891 | Comparison |
| 422 | " | (63) | " | " | " | 2070 | Invention |
| 423 | " | (40) | " | " | " | 2075 | " |
| 424 | " | (SS-4) | " | " | " | 897 | Comparison |
| 425 | " | (64) | " | " | " | 2087 | Invention |
| 426 | " | (50) | " | " | " | 2090 | " |

(S-1)

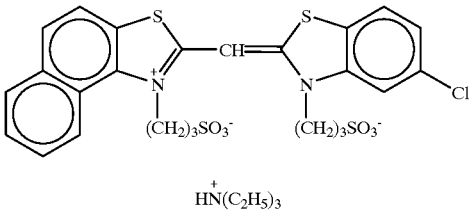

(S-2)

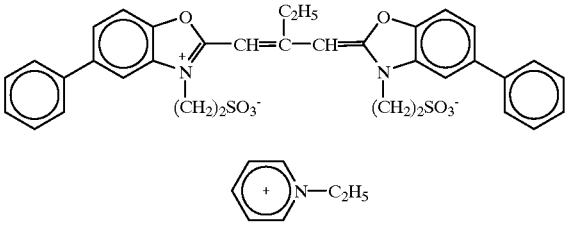

(S-3)

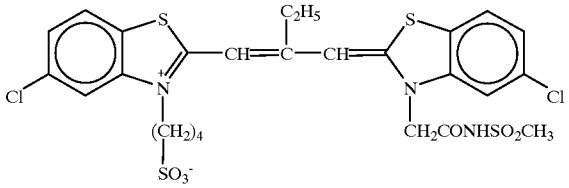

(SS-1)

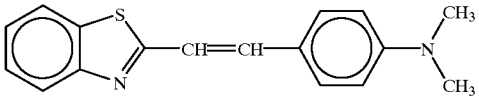

(SS-2)

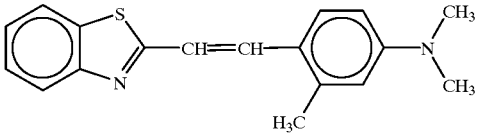

(SS-3)

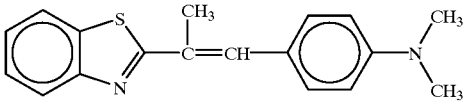

(SS-4)

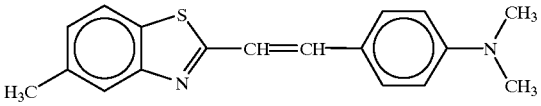

EXAMPLE 2

Making Emulsion 2-A (Emulsion comprising {111} AgCl Tabular Grains having high aspect ratio)

To 1.7 liter of water placed in a vessel, 3.8 g of sodium chloride, 3.05 millimole of the following compound (c) and 10 g of lime-processed ossein gelatin were added, and kept at 35° C. with stirring. Thereto, 28.8 cc of an aqueous solution containing 7.34 g of silver nitrate and 28.8 cc of an aqueous solution containing 2.71 g of sodium chloride were added over a period of 1 minutes in accordance with a double jet method. After a 2-minute lapse from the end of addition, 188 g of a 10% aqueous solution of trimellitated gelatin (prepared by modifying lime-processed ossein gelatin with trimellitic acid in a trimellitation degree of 98%) was added, and the temperature of the reaction vessel was raised to 75° C. within a period of 15 minutes and kept at 75° C. for 12 minutes to complete ripening. Then, the temperature of the reaction vessel was lowered to 60° C., and 480 cc of a solution containing 122.7 g of silver nitrate and an aqueous solution of sodium chloride were further added at an increasing flow rate over a 60-minute period. During the addition, the potential was kept at +100 mV with reference to the saturated calomel electrode.

Compound (c)

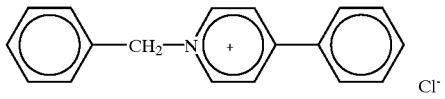

At the conclusion of the addition, the resulting emulsion was cooled to 40° C., and admixed with an aqueous solution of an anionic sedimentation agent to make the total volume 3 liter, and washed by adding sulfuric acid thereto till the pH became low enough to cause sedimentation of the emulsion.

The thus washed emulsion was admixed with 80 g of lime-processed gelatin, 85 cc of phenol (5%) and 242 cc of distilled water, and further adjusted to pH 6.2 and pAg 7.5. The emulsion grains obtained were tabular grains having an average projected area diameter of 1.7 μm and an average thickness of 0.12 μm and an average aspect ratio of 14.

Making Emulsion 2-B (Emulsion comprising {111} AgCl Tabular Grains having low aspect ratio)

To 1.7 liter of water placed in a vessel, 3.8 g of sodium chloride, 1.5 millimole of the foregoing compound (c) and 10 g of lime-processed ossein gelatin were added, and kept at 35° C. with stirring. Thereto, 28.8 cc of an aqueous solution containing 7.34 g of silver nitrate and 28.8 cc of an aqueous solution containing 2.71 g of sodium chloride were added over a period of 1 minute in accordance with a double jet method. After a 2-minute lapse from the end of addition, 188 g of a 10% aqueous solution of lime-processed ossein gelatin was added, and the temperature of the reaction vessel was raised to 75° C. within a period of 15 minutes and kept at 75° C. for 12 minutes to complete ripening. Then, 480 cc of a solution containing 122.7 g of silver nitrate and an aqueous solution of sodium chloride were further added at an increasing flow rate over a 39-minute period. During the addition, the potential was kept at +150 mV with reference to the saturated calomel electrode.

At the conclusion of the addition, the resulting emulsion was cooled to 40° C., and admixed with an aqueous solution of an anionic sedimentation agent to make the total volume 3 liter, and washed by adding sulfuric acid thereto till the pH became low enough to cause sedimentation of the emulsion The thus washed emulsion was admixed with 80 g of lime-processed gelatin, 85 cc of phenol (5%) and 242 cc of distilled water, and further adjusted to pH 6.2 and pAg 7.5. The emulsion grains obtained were tabular grains having an average projected area diameter of 1.2 μm and an average thickness of 0.24 and an average aspect ratio of 5.

Each of the foregoing two emulsions was subjected to chemical sensitization as it was kept at 60° C. with stirring. First, fine grains of pure silver bromide having a sphere equivalent grain diameter of 0.05 μm were added to each emulsion in an amount of 0.01 mole per mole of silver chloride. Thereto, after a 10-minute lapse, the compound relating to the present invention and the sensitizing dye shown in Tables 5, 6 or 7 were added in their respective amounts as set forth in Table 5, 6 or 7. Further, the resulting emulsions each were chemically sensitized with sodium thiosulfate and potassium chloroaurate so as to acquire the optimum sensitivity.

Preparation of Emulsion-Coated Samples:

Each of the emulsions sensitized in the foregoing manner was used in the amount of 1,307 g (corresponding to a silver content of 1 mole), and thereto the following ingredients were added to make a coating solution:

| | |
|---|---|
| 14% Water solution of inert gelatin | 756 g |
| Sodium 1-(3-sulfophenyl)-5-mercaptotetrazole | 0.129 g |
| Sodium dodecylbenzenesulfonate | 1.44 g |
| Sodium polystyrenesulfonate (average molecular weight: 600,000) | 1.44 g |
| Water to make the total amount | 4,860 cc |

On a cellulose triacetate film support provided with a subbing layer, each of the thus made coating solutions and a coating solution for surface protective layer were coated using a simultaneous extrusion method so as to have a silver coverage of 1.60 g/m$^2$ to prepare emulsion-coated Samples.

Evaluation of Photographic Characteristics:

The emulsion-coated Samples were each exposed for 1 second using a light source having a color temperature of 2854° K., via a filter transmitting light of wavelengths longer than 420 nm. Thereafter, each sample was developed with the following Developer D19 at 20° C. for 5 minutes, fixed for 30 seconds with a fixer, Super Fuji Fix (made by Fuji Photo Film Co., Ltd.), washed and then dried.

| Developer D19 | |
|---|---|
| Metol | 2.2 g |
| $Na_2SO_3$ | 96 g |
| Hydroquinone | 8.8 g |
| $NaCO_3.H_2O$ | 56 g |
| KBr | 5 g |
| $H_2O$ to make | 1,000 cc |

The optical densities of the thus processed films each were measured with a Fuji automatic densitometer. The fog of each sample was evaluated by the optical density in the unexposed area. The sensitivity of each sample was determined as the reciprocal of an exposure amount (expressed in lux·sec) required for providing the density of fog+0.2, and shown as relative values, with Sample No. 501 as a comparative example being taken as 100 (standard). The results obtained are shown in Tables 5, 6 and 7.

As can be seen from these tables, the sensitivity was increased by the use of compounds according to the present invention, and remarkable increase in sensitivity was achieved by the use of tabular silver halide emulsion grains having a high aspect ratio according to the present invention.

TABLE 5

| | | Compound | | Sensitizing Dye | | | |
|---|---|---|---|---|---|---|---|
| Sample No. | Emulsion | No. | Amount added (mol/mol Ag) | No. | Amound Added (mol/mol Ag) | Sensitivity | Remarks |
| 501 | 2-B | — | — | (S-1) | $6.0 \times 10^{-4}$ | 100 | Comparison |
| 502 | " | (SS-1) | $0.6 \times 10^{-4}$ | –" | " | 121 | " |
| 503 | " | (62) | " | " | " | 198 | " |
| 504 | " | (1) | " | " | " | 201 | " |
| 505 | " | (SS-2) | " | " | " | 118 | " |
| 506 | " | (39) | " | " | " | 181 | " |
| 507 | " | (28) | " | " | " | 192 | " |
| 508 | " | (SS-3) | " | " | " | 121 | " |
| 509 | " | (63) | " | " | " | 175 | " |
| 510 | " | (40) | " | " | " | 182 | " |
| 511 | " | (SS-4) | " | " | " | 120 | " |
| 512 | " | (64) | " | " | " | 195 | " |
| 513 | " | (50) | " | " | " | 199 | " |
| 514 | 2-A | — | — | " | $1 \times 10^{-3}$ | 210 | " |
| 515 | " | (SS-1) | $0.1 \times 10^{-4}$ | " | " | 231 | " |
| 516 | " | (62) | " | " | " | 605 | Invention |
| 517 | " | (1) | " | " | " | 610 | " |
| 518 | " | (SS-2) | " | " | " | 230 | Comparison |
| 519 | " | (39) | " | " | " | 595 | Invention |
| 520 | " | (28) | " | " | " | 597 | " |
| 521 | " | (SS-3) | " | " | " | 229 | Comparison |
| 522 | " | (63) | " | " | " | 590 | Invention |
| 523 | " | (40) | " | " | " | 594 | " |
| 524 | " | (SS-4) | " | " | " | 231 | Comparison |
| 525 | " | (64) | " | " | " | 598 | Invention |
| 526 | " | (50) | " | " | " | 603 | " |

TABLE 6

| Sample No. | Emulsion | Compound No. | Compound Amount added (mol/mol Ag) | Sensitizing Dye No. | Sensitizing Dye Amound Added (mol/mol Ag) | Sensitivity | Remarks |
|---|---|---|---|---|---|---|---|
| 601 | 2-B | — | — | (S-2) | $6.0 \times 10^{-4}$ | 150 | Comparison |
| 602 | " | (SS-1) | $0.6 \times 10^{-4}$ | –" | " | 171 | " |
| 603 | " | (62) | " | " | " | 301 | " |
| 604 | " | (1) | " | " | " | 308 | " |
| 605 | " | (SS-2) | " | " | " | 169 | " |
| 606 | " | (39) | " | " | " | 296 | " |
| 607 | " | (28) | " | " | " | 197 | " |
| 608 | " | (SS-3) | " | " | " | 171 | " |
| 609 | " | (63) | " | " | " | 165 | " |
| 610 | " | (40) | " | " | " | 168 | " |
| 611 | " | (SS-4) | " | " | " | 170 | " |
| 612 | " | (64) | " | " | " | 298 | " |
| 613 | " | (50) | " | " | " | 300 | " |
| 614 | 2-A | — | — | " | $1 \times 10^{-3}$ | 331 | " |
| 615 | " | (SS-1) | $0.1 \times 10^{-4}$ | " | " | 349 | " |
| 616 | " | (62) | " | " | " | 870 | Invention |
| 617 | " | (1) | " | " | " | 871 | " |
| 618 | " | (SS-2) | " | " | " | 352 | Comparison |
| 619 | " | (39) | " | " | " | 861 | Invention |
| 620 | " | (28) | " | " | " | 865 | " |
| 621 | " | (SS-3) | " | " | " | 354 | Comparison |
| 622 | " | (63) | " | " | " | 858 | Invention |
| 623 | " | (40) | " | " | " | 860 | " |
| 624 | " | (SS-4) | " | " | " | 353 | Comparison |
| 625 | " | (64) | " | " | " | 868 | Invention |
| 626 | " | (50) | " | " | " | 869 | " |

TABLE 7

| Sample No. | Emulsion | Compound No. | Compound Amount added (mol/mol Ag) | Sensitizing Dye No. | Sensitizing Dye Amound Added (mol/mol Ag) | Sensitivity | Remarks |
|---|---|---|---|---|---|---|---|
| 701 | 2-B | — | — | (S-3) | $6.0 \times 10^{-4}$ | 145 | Comparison |
| 702 | " | (SS-1) | $0.6 \times 10^{-4}$ | –" | " | 171 | " |
| 703 | " | (62) | " | " | " | 290 | " |
| 704 | " | (1) | " | " | " | 294 | " |
| 705 | " | (SS-2) | " | " | " | 164 | " |
| 706 | " | (39) | " | " | " | 285 | " |
| 707 | " | (28) | " | " | " | 287 | " |
| 708 | " | (SS-3) | " | " | " | 263 | " |
| 709 | " | (63) | " | " | " | 276 | " |
| 710 | " | (40) | " | " | " | 279 | " |
| 711 | " | (SS-4) | " | " | " | 165 | " |
| 712 | " | (64) | " | " | " | 288 | " |
| 713 | " | (50) | " | " | " | 290 | " |
| 714 | 2-A | — | — | " | $1 \times 10^{-3}$ | 298 | " |
| 715 | " | (SS-1) | $0.1 \times 10^{-4}$ | " | " | 321 | " |
| 716 | " | (62) | " | " | " | 860 | Invention |
| 717 | " | (1) | " | " | " | 861 | " |
| 718 | " | (SS-2) | " | " | " | 320 | Comparison |
| 719 | " | (39) | " | " | " | 847 | Invention |
| 720 | " | (28) | " | " | " | 851 | " |
| 721 | " | (SS-3) | " | " | " | 318 | Comparison |
| 722 | " | (63) | " | " | " | 841 | Invention |
| 723 | " | (40) | " | " | " | 845 | " |
| 724 | " | (SS-4) | " | " | " | 322 | Comparison |
| 725 | " | (64) | " | " | " | 854 | Invention |
| 726 | " | (50) | " | " | " | 858 | " |

In accordance with the present invention, silver halide photographic materials having very high sensitivity, compared with conventional ones, can be obtained.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a silver halide emulsion layer containing at least one compound selected from the group consisting of compounds represented by the following formulae (I), (II), (III) and (IV) wherein an average aspect ratio of silver halide emulsion grains constituting said silver halide emulsion layer is from 8 to 100:

(I)

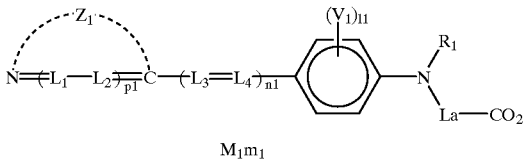

$M_1m_1$ wherein $Z_1$ represents atoms completing a 5- or 6-membered nitrogen-containing heterocyclic ring, $L_1$, $L_2$, $L_3$ and $L_4$ each represent a methine group, VI represents a monovalent substituent, $l_1$ is an integer of from 0 to 4, $p_1$ is 0 or 1, $n_1$ is 0, 1, 2, or 3, $R_1$ represents a hydrogen atom, an alkyl group, an aryl group or a heterocyclic group, $M_1$ represents a counter ion for adjusting the electric charge balance, $m_1$ is the number of counter ions necessary to render the molecule electrically neutral and ranges from 0 to 10, and La represents a methylene group;

(II)

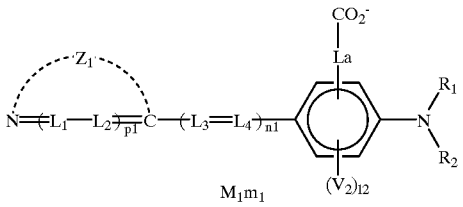

$M_1m_1$ wherein $Z_1$, $L_1$, $L_2$, $L_3$, $L_4$, $R_1$, $p_1$, $n_1$, $M_1$, $m_1$ and La have the same meanings as those in formula (I) respectively, $R_2$ has the same meaning as $R_1$, $V_2$ has the same meaning as $V_1$ in formula (I), and $l_2$ is an integer of from 0 to 3;

(III)

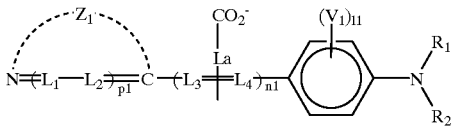

$M_1m_1$ wherein $Z_1$, $L_1$, $L_2$, $L_3$, $L_4$, $R_1$, $R_2$, $V_1$, $l_1$, $p_1$, $n_1$, $M_1$, $m_1$ and La have the same meanings as those in formula (I) or (II) respectively, provided that at least either $L_3$ or $L_4$ has La—$CO_2^-$ as a substituent; and (IV)

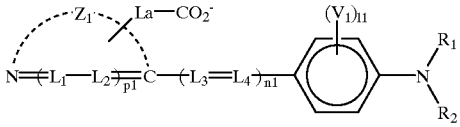

$M_1m_1$ wherein $Z_1$, $L_1$, $L_2$, $L_3$, $L_4$, $R_1$, $R_2$, $V_1$, $l_1$, $p_1$, $n_1$, $M_1$, $m_1$ and La have the same meanings as those in formula (I) or (II) respectively, provided that the nitrogen-containing heterocyclic ring completed by $Z_1$ has at least one La—$CO_2^-$ as a substituent, wherein the 5- or 6-membered nitrogen-containing heterocyclic ring completed by $Z_1$ in formulae (I) to (IV) may be fused together with a benzene or naphthalene ring and is unsubstituted or substituted with a substituent selected from the group consisting of a halogen atom, a mercapto group, a cyano group, a carboxyl group, a phospho group, a sulfo group, a hydroxyl group, a carbamoyl group containing 1 to 10 carbon atoms, atoms a sulfamoyl group containing 0 to 10 carbon atoms, a nitro group, an alkoxy group containing 1 to 20 carbon atoms, an aryloxy group containing 6 to 20 carbon atoms, an acyl group containing 1 to 20 carbon atoms, an acyloxy group containing 1 to 20 carbon atoms, an acylamino group containing 1 to 20 carbon atoms, a sulfonyl group containing 1 to 20 carbon atoms, a sulfinyl group containing 1 to 20 carbon atoms, a sulfonylamino group containing 1 to 20 carbon atoms, an amino group, a substituted amino group containing 1 to 20 carbon atoms, an ammonium group containing 0 to 15 carbon atoms, a hydrazino group containing 0 to 15 carbon atoms, an ureido group containing 1 to 15 carbon atoms, an imido group containing 1 to 15 carbon atoms, an alkylthio or arylthio group containing 1 to 20 carbon atoms, an alkoxycarbonyl group containing 2 to 20 carbon atoms, an aryloxycarbonyl group containing 6 to 20 carbon atoms, an unsubstituted alkyl group containing 1 to 18 carbon atoms, a substituted alkyl group containing 1 to 18 carbon atoms, an unsaturated hydrocarbon group containing 2 to 18 carbon atoms, a substituted or unsubstituted aryl group containing 6 to 20 carbon atoms, and an unsubstituted or substituted heterocyclic group containing 1 to 20 carbon atoms.

2. A silver halide photographic material according to claim 1, wherein said silver halide emulsion grains are emulsion grains spectrally sensitized with a sensitizing dye.

3. A silver halide photographic material according to claim 1, wherein said silver halide emulsion is a tabular grain emulsion prepared by feeding an aqueous solution of water-soluble silver salt and an aqueous solution of water-soluble halide into a mixing vessel arranged separately from a reaction vessel for carrying out a nucleation process and/or a growth process, stirring and mixing the aqueous solutions in the mixing vessel, thereby forming fine grains of silver halide, and feeding immediately the formed fine grains into the reaction vessel and making them undergo nucleation and/or growth in the reaction vessel.

4. A silver halide photographic material according to claim 2, wherein said silver halide emulsion is a tabular grain emulsion prepared by feeding an aqueous solution of water-soluble silver salt and an aqueous solution of water-soluble halide into a mixing vessel arranged separately from a reaction vessel for carrying out a nucleation process and/or a growth process, stirring and mixing the aqueous solutions in the mixing vessel, thereby forming fine grains of silver halide, and feeding immediately the formed fine grains into the reaction vessel and making them undergo nucleation and/or growth in the reaction vessel.

5. A silver halide photographic material according to claim 3, wherein the mixing vessel is provided with (i) a closed stirring tank having at least the desired number of inlets for feeding an aqueous solution of water-soluble silver salt and an aqueous solution of water-soluble halide and an outlet for discharging the silver halide fine grain emulsion formed upon completion of the stirring and (ii) a stirring means that is arranged inside the stirring tank and has no shaft passing through the tank wall but has at least one stirring blade which is driven into rotating to control a stirred condition of the liquid in the tank.

6. A silver halide photographic material according to claim 4, wherein the mixing vessel is provided with (i) a closed stirring tank having at least the desired number of inlets for feeding an aqueous solution of water-soluble silver salt and an aqueous solution of water-soluble halide and an outlet for discharging the silver halide fine grain emulsion formed upon completion of the stirring and (ii) a stirring means that is arranged inside the stirring tank and has no shaft passing through the tank wall but has at least one stirring blade which is driven into rotating to control a stirred condition of the liquid in the tank.

7. A silver halide photographic material according to claim 1, wherein the silver halide emulsion comprises an emulsion made in the presence of a gelatin having the carboxyl groups introduced in a ratio of at least one carboxyl group to one primary amino group by chemical modification of primary amino groups present therein.

8. A silver halide photographic material according to claim 1, wherein the silver halide emulsion is an emulsion prepared going through (a) a process of forming silver halide nuclei comprising twinned microcrystals in a dispersing medium under a condition that the chlorine content in the silver halide nuclei is at least 10 mole % to the silver content therein, (b) a process of ripening the silver halide nuclei so that tabular nuclei remain preferentially, and (c) a process of forcing the tabular nuclei to grow into tabular grains.

9. A silver halide photographic material according to claim 1, wherein the methylene group represented by La in formulae (I) to (IV) is a methylene group substituted with a substituted or unsubstituted alkyl group.

10. A silver halide photographic material according to claim 1, wherein the compound contained in the silver halide emulsion layer is a compound represented by formula (I) in which the La is a methylene group substituted with a substituted or unsubstituted alkyl group.

* * * * *